US011090539B2

(12) United States Patent
Yang et al.

(10) Patent No.: US 11,090,539 B2
(45) Date of Patent: Aug. 17, 2021

(54) APPARATUS AND METHODS TO TRACK SPORT IMPLEMENTS

(71) Applicant: Intel Corporation, Santa Clara, CA (US)

(72) Inventors: Songnan Yang, San Jose, CA (US); Zhen Yao, San Jose, CA (US); Xue Yang, Arcadia, CA (US); Stephanie Moyerman, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/594,756

(22) Filed: Oct. 7, 2019

(65) Prior Publication Data

US 2020/0078649 A1 Mar. 12, 2020

Related U.S. Application Data

(63) Continuation of application No. 15/495,673, filed on Apr. 24, 2017, now Pat. No. 10,434,391.

(51) Int. Cl.
*A63B 24/00* (2006.01)
*A63B 63/00* (2006.01)
(Continued)

(52) U.S. Cl.
CPC ..... *A63B 63/004* (2013.01); *A63B 63/008* (2013.01); *A63B 71/0605* (2013.01); *A63B 2024/0028* (2013.01); *A63B 2024/0037* (2013.01); *A63B 2102/24* (2015.10); *A63B 2220/62* (2013.01); *A63B 2220/833* (2013.01);
(Continued)

(58) Field of Classification Search
None
See application file for complete search history.

(56) References Cited

U.S. PATENT DOCUMENTS 4,375,289 A 3/1983 Schmall et al.
5,303,915 A 4/1994 Candy
(Continued)

FOREIGN PATENT DOCUMENTS

DE 102005046452 3/2007
GB 2346699 8/2000
JP 2009510852 3/2009

OTHER PUBLICATIONS

Coxworth, "NFL may track footballs using magnetic fields," posted on Jun. 13, 2014, retrieved from http://newatlas.com/football-tracking-magnetic-fields/32542/ on Apr. 24, 2017, 4 pages.
(Continued)

*Primary Examiner* — Damon J Pierce
(74) *Attorney, Agent, or Firm* — Hanley, Flight & Zimmerman, LLC

(57) ABSTRACT

Examples are disclosed to track sport implements and/or objects of interest. An example apparatus includes a first coil to generate a first magnetic field having a first vertical component with a zero magnitude along a first line of interest and a second coil partially overlapped with the first coil, where the second coil is to generate a second magnetic field. The example apparatus also includes a sensor to measure a magnitude of the first magnetic field in the first line of interest and a processor to determine an object of interest has crossed the first line of interest based on the magnitude of the first magnetic field measured by the sensor.

19 Claims, 21 Drawing Sheets

(51) Int. Cl.
*A63B 71/06* (2006.01)
*A63B 102/24* (2015.01)

(52) U.S. Cl.
CPC ..... *A63B 2220/89* (2013.01); *A63B 2243/007* (2013.01); *A63B 2243/0025* (2013.01)

(56) References Cited

U.S. PATENT DOCUMENTS

| | | | |
|---|---|---|---|
| 5,820,496 | A | 10/1998 | Bergeron |
| 7,795,861 | B2 | 9/2010 | Englert et al. |
| 7,867,113 | B2 | 1/2011 | Petersen |
| 8,057,325 | B2 | 11/2011 | Dalton et al. |
| 8,408,553 | B2 | 4/2013 | Eskildsen |
| 8,749,385 | B2 | 6/2014 | Bernhard et al. |
| 9,795,829 | B2 | 10/2017 | Hartmann et al. |
| 10,434,391 | B2 | 10/2019 | Yang et al. |
| 2006/0178236 | A1 | 8/2006 | Mosbey |
| 2007/0299625 | A1 | 12/2007 | Englert et al. |
| 2008/0085790 | A1 | 4/2008 | Englert |
| 2008/0090683 | A1 | 4/2008 | Englert et al. |
| 2009/0072817 | A1 | 3/2009 | Bucher |
| 2009/0108835 | A1 | 4/2009 | Englert et al. |
| 2010/0181996 | A1 | 7/2010 | Englert et al. |
| 2010/0321185 | A1 | 12/2010 | Bernhard et al. |
| 2011/0304497 | A1 | 12/2011 | Molyneux et al. |
| 2012/0040783 | A1 | 2/2012 | Bucher |
| 2014/0035566 | A1 | 2/2014 | Arumugam et al. |
| 2015/0285611 | A1 | 10/2015 | Lowery et al. |
| 2016/0107028 | A1 | 4/2016 | Hartmann et al. |

OTHER PUBLICATIONS

Arumugam et al., "Two-Dimensional Position Measurement Using Magnetoquasistatic Fields," IEEE, Sep. 12-16, 2011, 4 pages.
Arumugam, "Position and Orientation Measurements Using Magnetoquasistatic Fields," Carnegie Mellon University, Department of Electrical Computer Engineering, Dec. 21, 2011, 156 pages.
Arumugam et al. "Three-Dimensional Position and Orientation Measurments Using Magneto-Quasistatic Fields and Complex Image Theory," IEEE Antennas and Propagation Magazine, vol. 56, No. 1, Feb. 2014, 14 pages.
"Goal-Line Technology", Wikipedia, Aug. 30, 2016, retrieved from the Internet at https://en.m.wikipedia.org/wiki/Goal-line_technology on Sep. 7, 2016, 9 pages.
Fraunhofer IIS, "GoalRef—Goal-Line Technology," Fraunhofer Institute for Integrated Circuits IIS, Nov. 2013, 6 pages.
International Searching Authority, "International Search Report and Written Opinion", issued in connection with application No. PCT/US2017/045515 dated Nov. 15, 2017, 11 pages.
United States Patent and Trademark Office, "Non-Final Office Action," issued in connection with U.S. Appl. No. 15/264,361, dated Nov. 22, 2017, 12 pages.
United States Patent and Trademark Office, "Non-Final Office Action", issued in connection with U.S. Appl. No. 15/264,361, dated Sep. 19, 2018, 6 pages.
United States Patent and Trademark Office, "Final Office Action", issued in connection with U.S. Appl. No. 15/264,361, dated May 23, 2018, 10 pages.
United States Patent and Trademark Office, "Restriction", issued in connection with U.S. Appl. No. 15/495,673, dated Mar. 19, 2018, 6 pages.
United States Patent and Trademark Office, "Non-Final Office Action", issued in connection with U.S. Appl. No. 15/495,673, dated Jul. 17, 2018, 11 pages.
United States Patent and Trademark Office, "Non-Final Office Action", issued in connection with U.S. Appl. No. 15/495,673, dated Dec. 31, 2018, 11 pages.
United States Patent and Trademark Office, "Notice of Allowance and Fee(s) Due", issued in connection with U.S. Appl. No. 15/495,673, dated May 28, 2019, 5 pages.
United States Patent and Trademark Office, "Restriction and/or Election Requirement," issued in connection with U.S. Appl. No. 16/417,171, dated Jul. 20, 2020, 5 pages.
United States Patent and Trademark Office, "Final Office Action," issued in connection with U.S. Appl. No. 16/417,171, dated Mar. 17, 2021, 8 pages.
United States Patent and Trademark Office, "Non-Final Office Action," issued in connection with U.S. Appl. No. 16/417,171, dated Oct. 20, 2020, 10 pages.

APPARATUS AND METHODS TO TRACK SPORT IMPLEMENTS

RELATED APPLICATION

This patent arises from a continuation of U.S. patent application Ser. No. 15/495,673, which was filed on Apr. 24, 2017. U.S. patent application Ser. No. 15/495,673 is hereby incorporated herein by reference in its entirety. Priority to U.S. patent application Ser. No. 15/495,673 is hereby claimed.

FIELD OF THE DISCLOSURE

This disclosure relates generally to sport implements and, more particularly, to apparatus and methods to track sport implements.

BACKGROUND

In sporting events, such as hockey or football for example, the location of a sport implement such as a puck or a ball plays an important role in determining an outcome of a game. For example, whether a puck travels across a goal line and into a goal is an important determination in hockey. Similarly, in American style football, whether a football travels across a goal line and into an end zone is an important determination affecting the outcome of a game.

Figure 1:
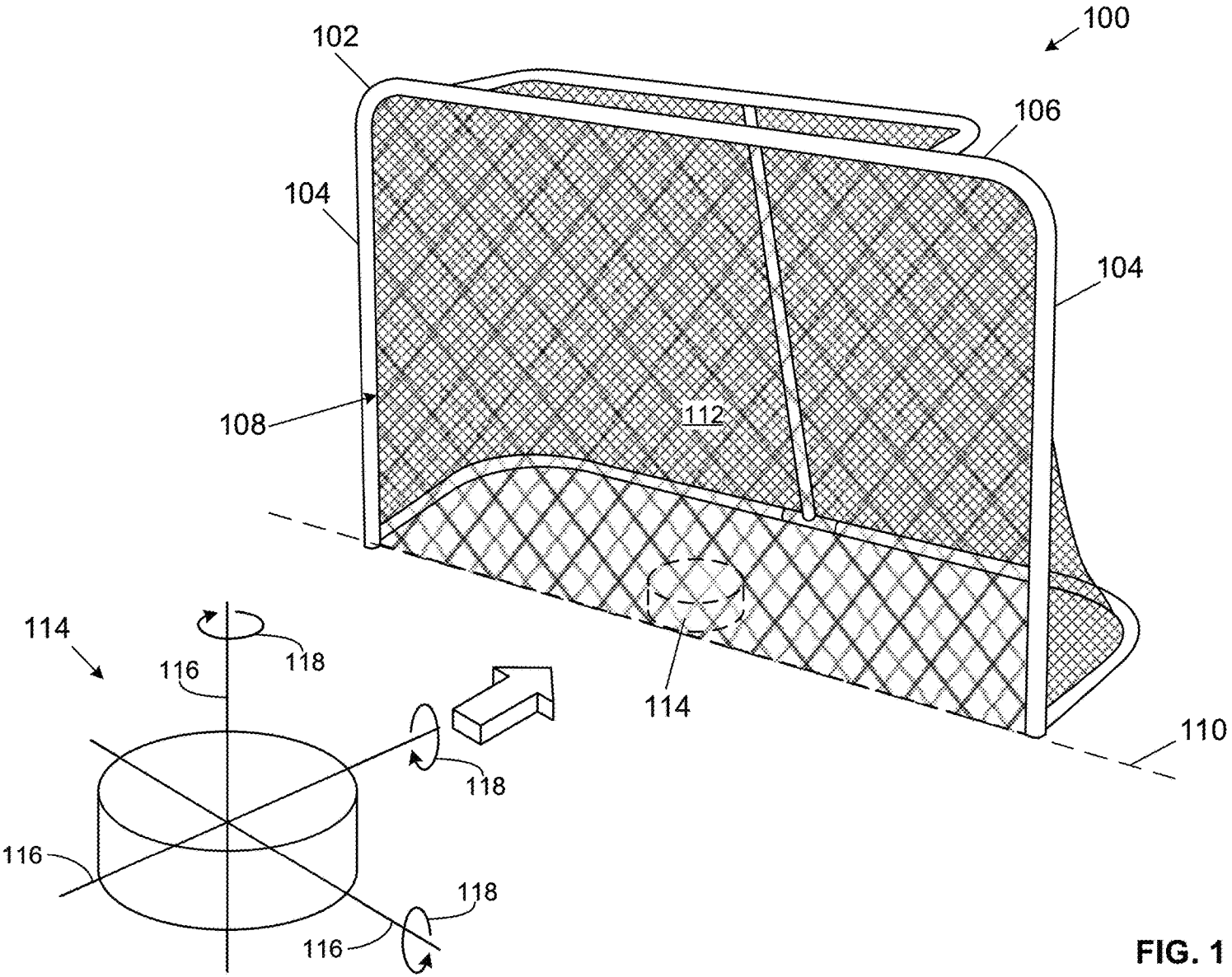
FIG. 1 illustrates an example sport application.

The figures are not to scale. Instead, for clarity, the thickness of the layers and/or regions may be enlarged in the drawings. Wherever possible, the same reference numbers will be used throughout the drawing(s) and accompanying written description to refer to the same or like parts. As used in this patent, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Methods and apparatus to track sport implements are disclosed herein. In sporting events (e.g., hockey, soccer, American style football, rugby, auto racing, running, etc.), an object of interest and/or sport implement such as a ball, a puck, a shoe, and/or a car plays an important role in determining an outcome of a game. However, the speed at which these objects can travel (e.g., greater than 100 miles per hour (mph)) may make conditional determinations difficult (e.g., whether a team has scored). For example, video replays captured by high-speed cameras are subject to occlusion, blurring and/or unclear/obstructed viewing angles. Additionally or alternatively, the view of the sport implement is often blocked by one or more players at or near a goal line, such as in a goal-line pile up in American style football. As a result, it is extremely difficult (if not impossible) for a referee or camera to see if the object actually crossed the goal line.

Some known positional tracking systems utilize magnetic sensors disposed around a soccer goal to determine a location of a soccer ball near the goal line. However, these known systems can only determine a location of a soccer ball within a few centimeters. In other sports, the sport implement may be relative small and, thus, a few centimeters (or less) may be the difference between a goal or no goal. Thus, these known systems do not provide accurate detection for other sports. Further, these known systems require placing sensors and circuitry (such as an antenna array) around the goal frame, which is cumbersome and requires modification of the sports goal. This process is also complex with smaller goals, such as hockey goals. Additionally, because the sensors and circuitry are exposed around the goal frame, the sensors and circuitry can be damaged during game play, rendering them useless. Moreover, in some sports, the goal line or zone of interest is not defined by a frame or goal post. For example, in American style football, there are no goal frames to which the known magnetic sensors could be attached. Thus, known systems are not applicable for all sports.

Examples methods, apparatus, systems and/or articles of manufacture are disclosed herein that enable cost-effective, highly accurate and quick determinations of the location of an object of interest (e.g., a ball, a puck, a person, a vehicle, a bicycle, a drone, a robot, etc.) relative to a line or plane of interest (e.g., a goal line, a finish line, etc.). In particular, example methods, apparatus, systems and/or articles of manufacture disclosed herein may be used to determine whether the object of interest, such as a sport implement, has crossed over a line or plane of interest, such as a goal line. Examples disclosed herein utilize a coil (e.g., a transmitter coil), sometimes referred to as a goal line coil, disposed below a sports field (e.g., ice, grass) that generates a magnetic field around the sports field. The coil is positioned such that a section of the coil is aligned along a goal line, a finish line, or other line of interest. As such, a zero-crossing plane is generated above the section of the coil along the goal line and defines a line or plane of interest, which can be used to determine whether the sport implement crossed the goal line. As used herein, the term "zero-crossing plane" means a plane or 3D surface where the Z direction component of the magnetic field (designated as $B_Z$) generated by a coil (in the direction of the magnetic field) is zero or substantially zero. Additionally, as used herein, the term "plane of interest" refers to a plane that is to be monitored for a presence and/or movement of an object, and may encompass a goal line, a goal structure, a net, a finish line, a field goal upright, a foul line, etc. As used herein, the terms "sport implement" and "sports implement" are used interchangeably and encompass objects such as balls (e.g., soccer balls, footballs, golf balls, etc.), pucks (e.g., hockey pucks), automobiles, boats, drones, shoes, vehicles, bicycles, etc. in which location movements are relevant to outcome determinations including such as scoring determinations.

In some examples, a sport implement and/or other object of interest includes a sensor, such as a receiver coil, that detects and/or measures the strength of the magnetic field generated by the coil. When the sensor measures a Z direction magnetic field $B_Z$ of zero or substantially zero, it can be determined that the sport implement crossed the zero-crossing plane, which is aligned with the goal line, and, thus, a goal has been scored. Thus, examples disclosed herein can be used to determine the crossing of a plane of interest, such as a goal line. In some instances, this determination is used to supplement existing camera tracking systems. For example, a traditional camera tracking system may determine the sport implement is near the goal line, but the view may be blocked by one or more players. In such an instance, example systems disclosed herein may be used to determine whether the sport implement crossed the goal line.

In some examples, the sport implement is capable of spinning or turning while in play. In some such examples, the receiver coil includes three orthogonal coils that capture the magnetic field along the different axes of the sport implement. In some examples, the orientation of the sport implement is needed to determine the Z magnetic field component experienced by the sport implement. In some examples, to determine the orientation of the sport implement, a calibration coil (sometimes referred to as an orientation coil) is disposed at or near the plane of interest. The calibration coil generates a magnetic field with a known direction (e.g., vertical), and the sensor measures the magnetic field generated by the calibration coil to determine an orientation of the sport implement. Then, the goal line coil disposed along the plane of interest is activated, and the sensor measures the magnetic field (using the determined orientation) experienced by the sport implement. If the Z direction magnetic field $B_Z$ is zero, it can be determined that the sport implement crossed the goal line.

Further, examples disclosed herein can be used to determine whether a sport implement has crossed a plane of interest without having a frame or goal post to define the plane of interest. Thus, unlike the known systems that require sensors placed around a frame of a goal, examples disclosed herein can be implemented with any sport, such as football, cycling, running, automotive racing, etc. where only crossing of a line or plane (e.g., a finish line) is important irrespective of a net, frame, or the like. Furthermore, in some disclosed examples, the transmitter coil is buried in the sports field. Thus, examples disclosed herein do not require modification of a goal. Additionally, because in such examples the coil is embedded in the playing surface, there is no risk of damage to the coil like in known systems. Examples disclosed herein are capable of detecting the location of an object of interest or sport implement within a few millimeters or less. Thus, examples disclosed herein are more accurate than known systems.

FIG. 1 illustrates an example sport application. According to the illustrated example, a goal 100 (e.g., a hockey goal) includes a frame 102 with uprights 104 and a crossbar 106 that form an opening 108. The opening 108 formed by the uprights 104 and the crossbar 106 is aligned with a goal line 110, which forms a plane of interest 112 that is pertinent to a determination of whether a score/goal has been made. An example puck 114 is illustrated in FIG. 1. The example puck 114 has multiple axes (e.g., orthogonal axes in x, y and z coordinate systems) of movement 116 as well as axes (e.g., orthogonal axes) of rotation 118. In this example, whether the example puck 114 has crossed the goal line 110 and into the goal 100 (i.e., crossed the plane of interest 112) is pertinent to whether a score (e.g., a goal) has been made. Accordingly, examples disclosed herein can accurately determine whether a sport implement, such as the puck 114 has crossed a plane of interest, such as the plane of interest 112 to determine, for instance, if a goal has occurred.

Figure 2:
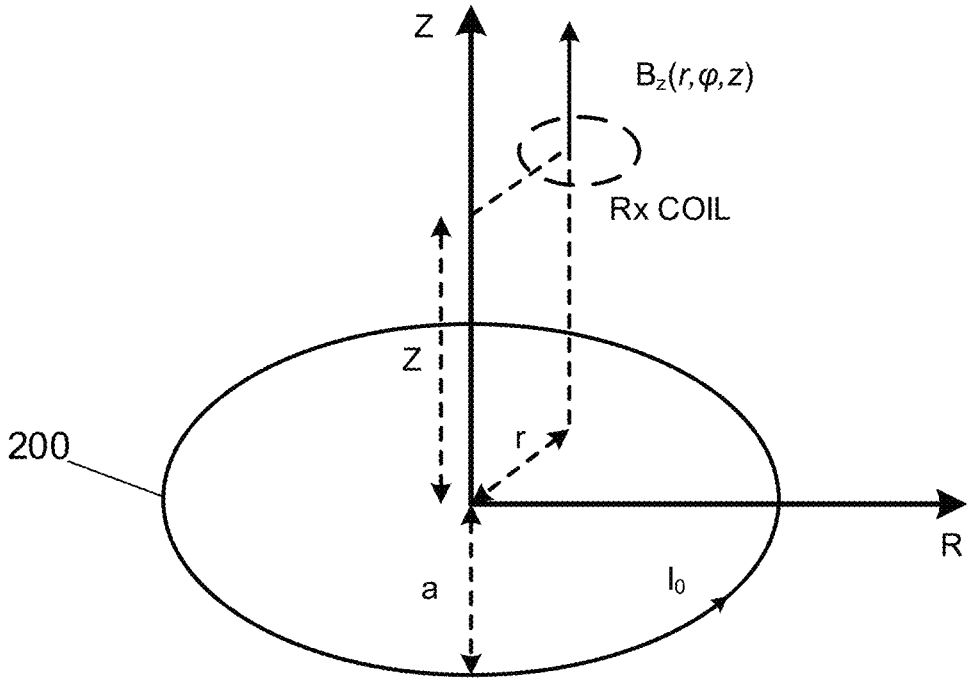
FIG. 2 illustrates an example coil that may generate a magnetic field and which may be implemented in accordance with the methods and apparatus disclosed herein.

FIG. 2 illustrates an example coil 200 (e.g., a transmitter coil) that may be used to create a zero-crossing plane. The zero-crossing plane may be used as the target magnetic field characteristic or property to determine whether an object (e.g., a sports implement) has crossed a line or plane of interest and/or a position of the object relative to the plane. In general, the example coil 200 generates a magnetic field (e.g., an alternating magnetic field) when a current (e.g., an alternating current (AC)) is applied to the coil 200. The Z direction component ($B_Z$) of the magnetic field generated by of a single circular coil centered at origin (as shown in FIG. 2) is given using Equation 1 below.

$$B_Z(r, \varphi, z) = \frac{\mu_0 I_0}{2\pi\sqrt{(r+a)^2+z^2}} \cdot \left[K(k_c) - \frac{r^2-a^2+z^2}{(r-a)^2+z^2}E(k_c)\right] \quad \text{Equation 1}$$

In Equation 1, and with reference to FIG. 2, $\mu_0$ is the permeability constant, $I_0$ is the current, r is the distance or radius from the Z axis (located at the center of the coil), a is the radius of the coil 200, and z is the height along the Z axis from the plane of the coil 200 (e.g., where Z=0). Further, K(k) and E(k) are, respectively, the complete elliptic integral functions of the first and second kind. The $k_c$ term can be found using Equation 2 below.

$$k_c^2 = \frac{4ar}{(r+a)^2+z^2} \quad \text{Equation 2}$$

Thus, Equation 1 can be used to determine the Z direction magnetic field $B_Z$ experienced by an example receiver coil ($R_X$) at r and z (cylindrical coordinates).

Figure 3:
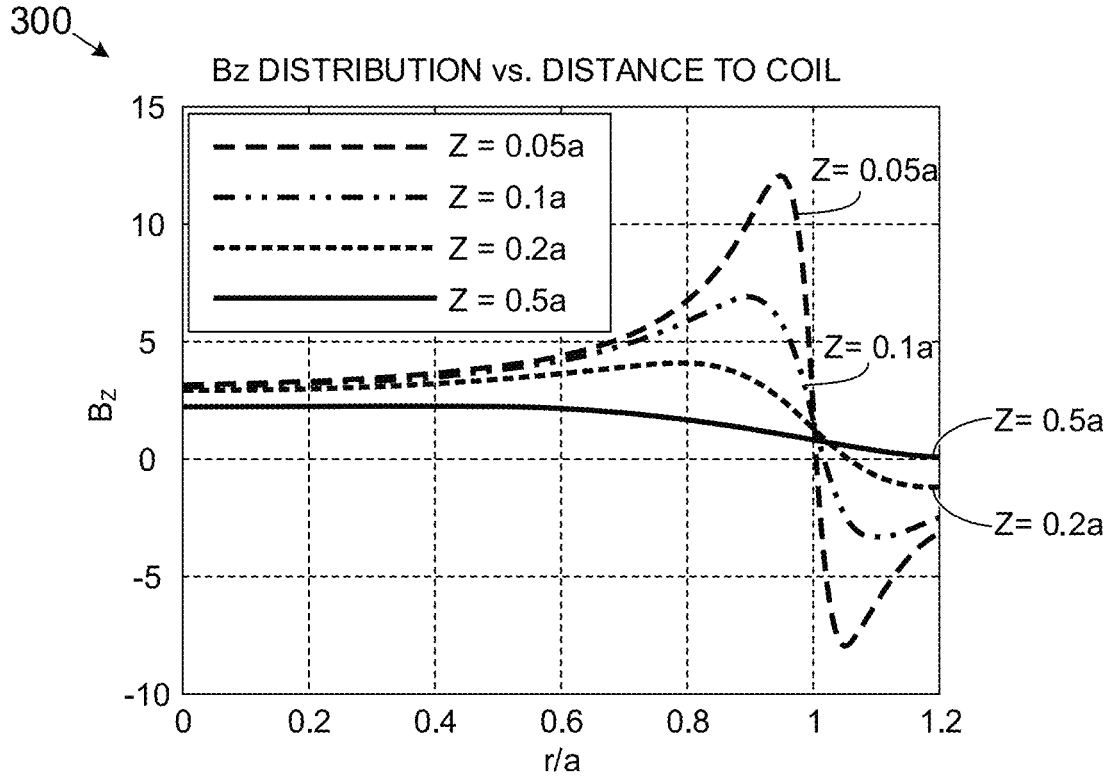
FIG. 3 is an example graph illustrating the magnetic field strength generated by the example coil of FIG. 2 at different heights and at different radial distances from a center of the example coil.

FIG. 3 is an example graph 300 illustrating the $B_Z$ distribution versus the distance from the center of the coil 200. In particular, the X-axis represents a ratio of the distance r to the radius a of the coil 200, and the Y-axis represents the strength or magnitude of the magnetic field component in the Z direction ($B_Z$). A plurality of lines representing different heights z (vertical separations) are plotted. As can be seen, when the distance r is equal to or near the radius a of the coil 200 (i.e., at r/a=1), the Z direction magnetic field $B_Z$ drops to zero. In other words, if the coil 200 is in a horizontal (ground) plane, a sensor positioned directly above the coil 200 will sense a Z direction magnetic field $B_Z$ of zero or substantially zero (e.g., within a noise tolerance). Thus, a plane of zero magnetic field $B_Z$ in the Z direction is created directly above the coil 200. This plane is referred to as a zero-crossing plane. As the distance r increases (outside of the radius a of the coil 200), the amplitude or strength Z direction magnetic field $B_Z$ reverses and generates a negative $B_Z$ value. Also, as can be seen by the location of the different z lines, the higher the distance z above the plane of the coil, the lower the strength of the magnetic component in the Z direction.

Figure 4:
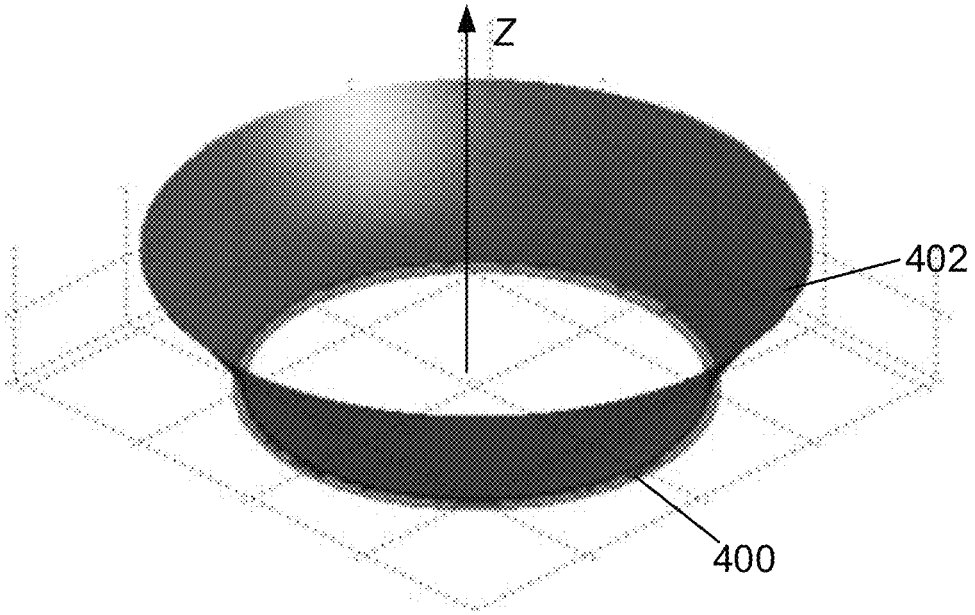
FIG. 4 illustrates an example zero-crossing plane generated by an example circular coil and that may be implemented in accordance with the methods and apparatus disclosed herein.
Figure 5:
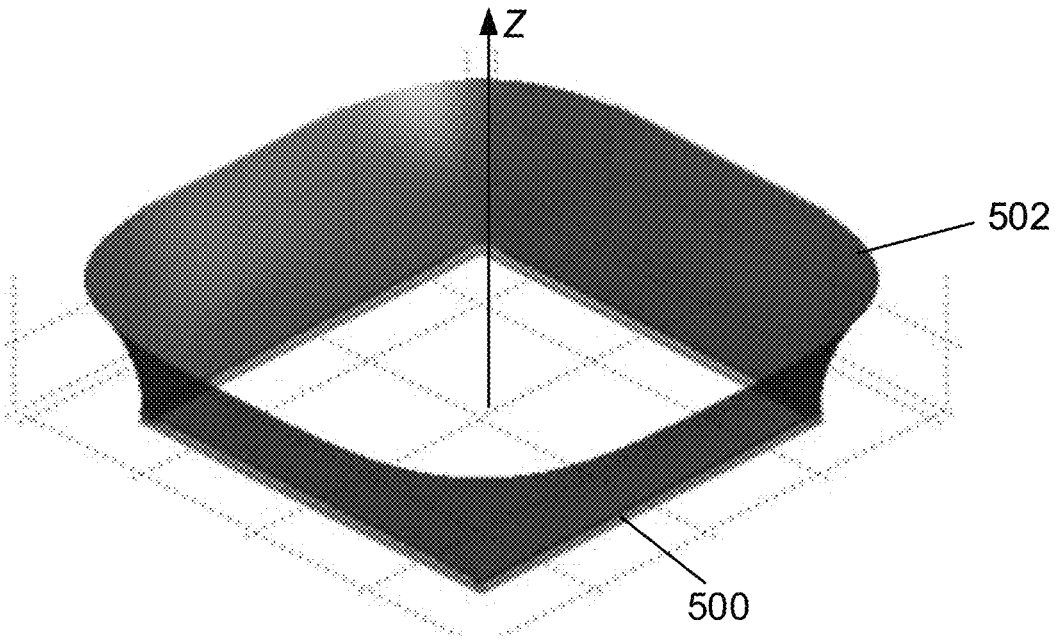
FIG. 5 illustrates an example zero-crossing plane generated by an example square-shaped coil and that may be implemented in accordance with the methods and apparatus disclosed herein.

FIGS. 4 and 5 illustrate 3D plots of the zero-crossing planes generated by different shaped coils. For example FIG. 4 illustrates an example coil 400 and an example zero-crossing plane 402 generated by the example coil 400. In the example of FIG. 4, the coil 400 is circular. The zero-crossing plane 402 represents the surface where the Z direction component of the magnetic field $B_Z$ is zero. As illustrated, the zero-crossing plane 402 warps (e.g., curves, bows, etc.) outward as the distance in the Z direction increases (i.e., as a sensor detects the field moving further from the coil 400 in the Z direction). However, the zero-crossing plane 402 is substantially vertically at or close to the coil 400. In the illustrated example, the coil 400 is a single loop coil. However, in other examples, the coil 400 may have more than one loop.

FIG. 5 illustrates another example coil 500 and a zero-crossing plane 502 generated by the example coil 500. In the example illustrated in FIG. 5, the coil 500 is rectangular-shaped and, thus, has four straight or substantially straight lines or sections. Similar to the coil 400 in FIG. 4, the coil 500 generates the zero-crossing plane 502, which is relatively straight or planar near the coil 500 and curves or bow outward as the distance from the coil 500 in the Z direction increases. In the illustrated example, the coil 500 is a single loop coil. However, in other examples, the coil 500 may have more than one loop. The amount of warpage (e.g., in either the example of FIG. 4 or FIG. 5 or another example) is dependent on the size (e.g., diameter) of the coil. Thus, coils with larger diameters have flatter or straighter zero-crossing planes, whereas coils with smaller diameters tend to have more warpage closer to the coil.

Examples disclosed herein leverage this zero-crossing plane effect to track a location of an object and/or sport implement. In particular, the zero-crossing plane 402, 502 may be used to determine whether an object of interest and/or sport implement has crossed a plane of interest (e.g., a goal-line). For example, the coil 500 may be positioned such that the zero-crossing plane 502 is aligned along a plane of interest such as a goal line. The object and/or sport implement includes a sensor that detects and/or measures the magnetic field produced by the coil 500. When the object and/or sport implement detects the Z direction magnetic field $B_Z$ is zero, the object and/or sport implement has crossed the zero-crossing plane 502 and, thus, has crossed the plane of interest (e.g., the goal line). In other words, the Z direction magnetic field $B_Z$ is non-zero everywhere else except directly above the coil 500. Therefore, when the object and/or sport implement detects the Z direction magnetic field $B_Z$ is zero or substantially zero (e.g., to account for noise), it can be determined that the object and/or sport implement has crossed the zero-crossing plane. Additionally, because the zero-crossing plane 502 is relatively vertical (e.g., straight) near the coil 500, the zero-crossing plane 502 can be used to accurately detect crossing of the plane of the interest at different heights in the Z direction.

Figure 6:
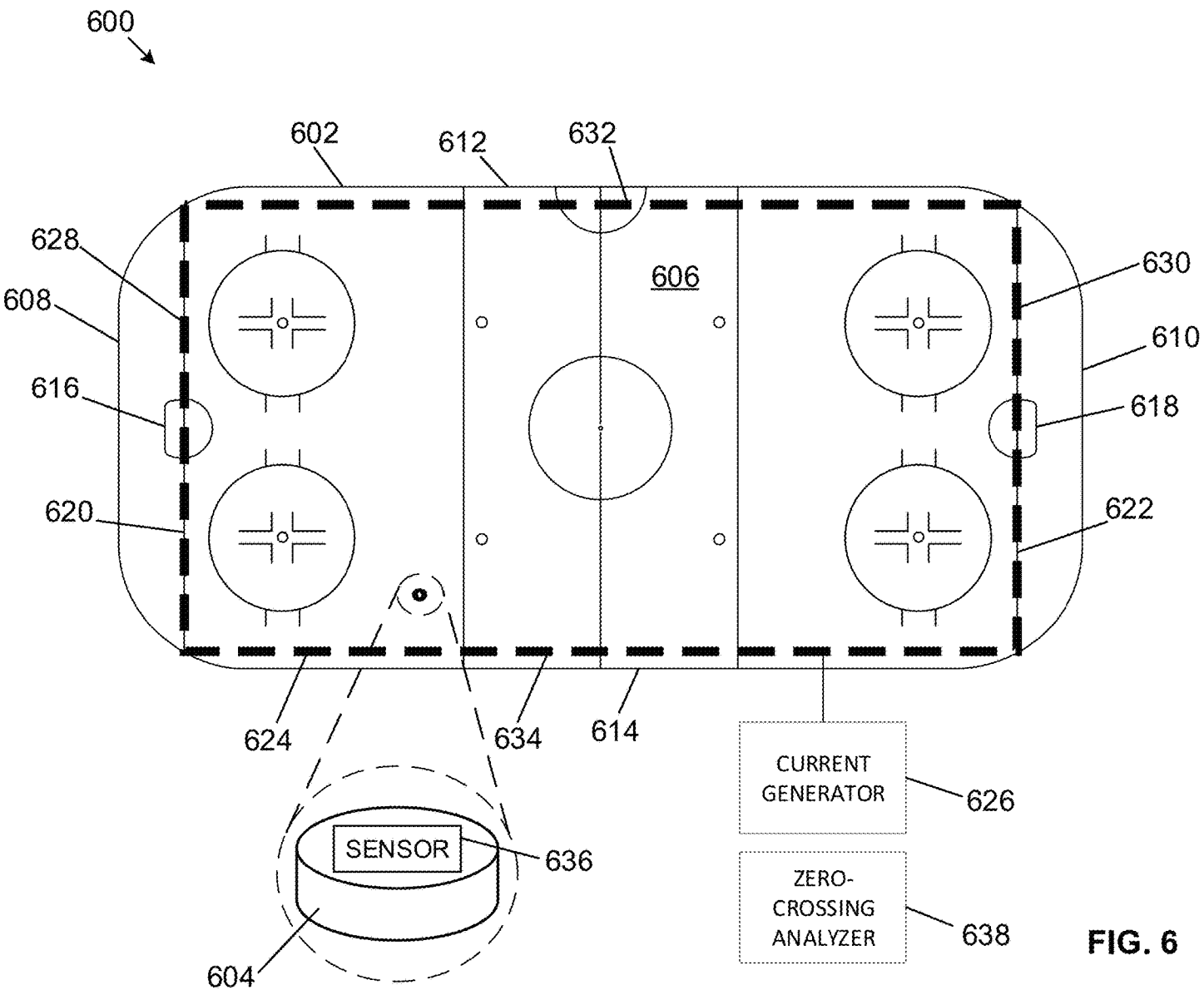
FIG. 6 illustrates an example sport tracking system, implemented in connection with an example hockey rink, having an example coil and constructed in accordance with the teachings of this disclosure.

FIG. 6 illustrates an example sport tracking system 600 constructed in accordance with the teachings of this disclosure. In the illustrated example, the sport tracking system 600 is implemented in connection with a sports field and a sport implement. In particular, in the illustrated example of FIG. 6, the sports field is an example hockey rink 602 and the sport implement is an example hockey puck 604. The hockey rink 602 includes a floor or playing surface 606 (e.g., ice) defined between a first end wall 608 and a second end wall 610 opposite the first end wall 608 (which form a length of the hockey rink 602) and a first side wall 612 and a second side wall 614 opposite the first side wall 612 (which form a width of the hockey rink 602). A first goal 616 is located near the first end wall 608 of the hockey rink 602 and a second goal 618 is located near the second end wall 610 of the hockey rink 602. In some examples, the playing surface 606 of the hockey rink 602 includes various lines indicating different boundaries. In the illustrated example, the hockey rink 602 includes a first goal line 620 near the first end wall 608 that spans the width of the hockey rink 602. The first goal line 620 is aligned with the front or opening of the first goal 616 and is used to judge goals and icing calls. In other words, the first goal line 620 forms a plane of interest (e.g., a vertical plane of interest) along a frame of the first goal 616. A puck that crosses the first goal line 620 (e.g., the plane of interest) and travels into the first goal 616 is considered a goal. Similarly, the hockey rink 602 includes a second goal line 622 near the second end wall 610 spanning the width of the hockey rink 602 and aligned with the front or opening of the second goal 618.

To determine whether the puck 604 has crossed the first or second goal lines 620, 622 (e.g., a plane of interest) and into one of the first or second goals 616, 618, the sport tracking system 600 includes an example goal line coil 624 (e.g., a transmitter or source coil). In the illustrated example, the goal line coil 624 is disposed below (e.g., buried in) the playing surface 606 (e.g., beneath the ice). As such, the goal line coil 624 does not interfere with the hockey game. When a current is induced in the goal line coil 624, the goal line coil 624 generates a magnetic field. In the illustrated example, the coil goal line 624 is oriented along the horizontal plane that is perpendicular to the vertical plane of interest (i.e., the first goal line 620 and/or the second goal line 622). Thus, the Z magnetic field component $B_Z$ of the magnetic field is in the vertical direction (into and out of the drawing in FIG. 6). In the illustrated example, the sport tracking system 600 includes an example current generator 626 (e.g., transmitter circuitry) that generates an AC current in the goal line coil 624 to generate the magnetic field. The current generator 626 ensures a magnetic field is consistently generated by the goal line coil 624 throughout the game or as long as desired. In some examples, the magnetic field generated by the goal line coil 624 is a low frequency (LF) AC magnetic field (e.g., 30-300 kilo-hertz (KHz)). In other examples, the magnetic field may oscillate at other frequencies. In some examples, using a LF AC magnetic field enables the magnetic field to penetrate (i.e., not be obstructed by) objects on the hockey rink 602, such as non-ferromagnetic materials and humans. As such, the magnetic field generated by the goal line coil 624 extends above the ice. Thus, the example sport tracking system 600 can sense the magnetic field to accurately track the puck 604 even if there is optical occlusion (e.g., the puck 604 is covered or obstructed by a player). The example goal line coil 624 may include one turn or multiple turns (e.g., 10 turns).

In the illustrated example, the goal line coil 624 includes one or more sections (e.g., portions, sides) that define a loop. In particular, the goal line coil 624 includes a first section 628, a second section 630 parallel to and opposite the first section 628, a third section 632 and a fourth section 634 parallel to and opposite the third section 632. As such, the goal line coil 624 is in the shape of a relatively large rectangular, which covers a majority of the hockey rink 602. In the illustrated example, the goal line coil 624 is positioned such that the first section 628 of the goal line coil 624 is aligned along the first goal line 620, the second section 630 of the goal line coil 624 is aligned along the second goal line 622, and the third section 632 and the fourth section 634 are disposed along the first and second side walls 612, 614, respectively, and between the first and second sections 628, 630.

Figure 7:
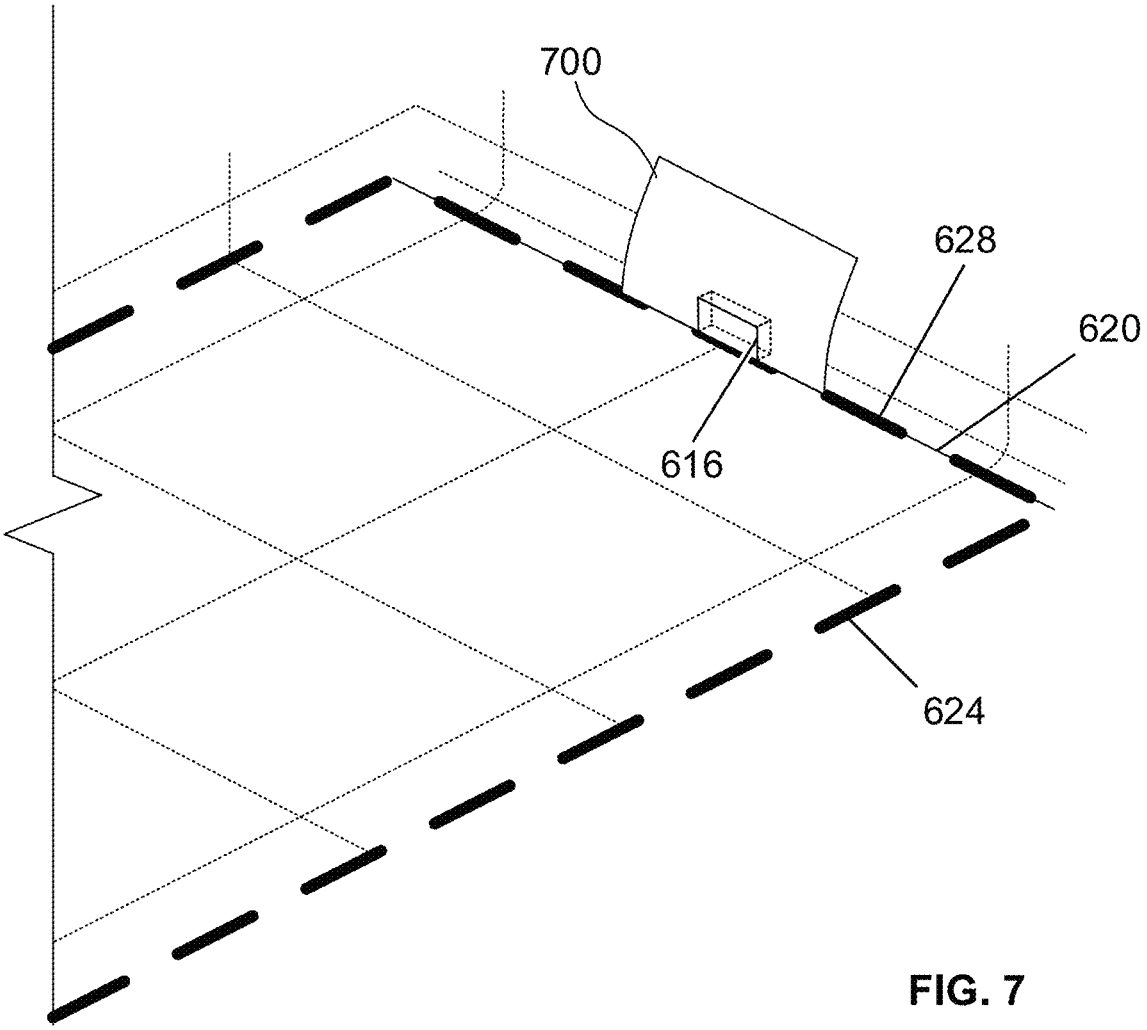
FIG. 7 illustrates an example zero-crossing plane generated by the example coil of the example sport tracking system of FIG. 6.

In the illustrated example, the goal line coil 624 generates a magnetic field having a Z direction magnetic field component $B_Z$ in the vertical direction (into and out of the drawing in FIG. 6), similar to the coils 200, 400, 500 disclosed in connection with FIGS. 3, 4 and 5. As a result, a zero-crossing plane is generated above the goal line coil 624 where the Z direction magnetic field $B_Z$ is zero. For example, FIG. 7 illustrates a portion of a zero-crossing plane 700 created by the goal line coil 624 above the first section 628 of the goal line coil 624. The goal line coil 624 is orientated along a horizontal plane. Therefore, the vertical component (the Z direction component) of the magnetic field has a zero magnitude along the first goal line 620. As can be seen from FIG. 7, the zero-crossing plane 700 is substantially vertical along the first goal line 620 from a bottom to a top of the first goal 616. Because of the size of the goal line coil 624 (which surrounds a majority of the hockey rink 602 (FIG. 6)) the warpage of the zero-crossing plane 700 is relatively small (or negligible) along the height (e.g., 1.2 meters (m)) of the first goal 616. Thus, the zero-crossing plane 700 is substantially aligned with the plane of interest from the bottom to the top of the first goal 616 and, thus, can be used to accurately detect a crossing of the first goal line 620 (e.g., the plane of interest) at any height between the bottom and the top of the first goal 616.

Referring back to FIG. 6, the example puck 604 includes a sensor 636 that measures and/or detects the magnitude of Z direction magnetic field $B_Z$ (e.g., the portion of the magnetic field generated above the ice in the vertical direction by the goal line coil 624). The sensor 636 may include, for example, one or more receiver coils (disclosed in further detail herein), which may be passively or actively powered. The sensor 636 measures the magnitude of the magnetic field as the puck 604 moves near and over the first and second goal lines 620, 622. The Z direction magnetic field $B_Z$ is non-zero everywhere else except directly above the goal line coil 624. When the puck 604 crosses the zero-crossing plane 700 (FIG. 7) anywhere along the first goal line 620 (above the first section 628 of the goal line coil 624), for example, the sensor 636 detects and/or measures that the Z direction magnetic field $B_Z$ is zero or substantially zero. Likewise, a zero-crossing plane is generated above the second section 630 (FIG. 6) of the goal line coil 624 and, thus, along the second goal line 620 (FIG. 6). This measurement can be used to help determine if the puck 604 crossed the first or second goal lines 620, 622 and into the respective first or second goal 616, 618. For example, if there is a pile-up of players in front of the first goal 616, it may be difficult (if not impossible) to see whether the puck 604 actually crossed the first goal line 620. Using the example sport tracking system 600 of FIG. 6, a referee or other official can accurately determine if the puck 604 crossed the first goal line 620 based on the magnitude of the magnetic field as experienced by the puck 604 (e.g., as measured by the sensor 636). In some examples, the crossing of a zero-crossing plane indicates a possible goal, which may be verified by an official and/or another tracking device to determine whether the puck 604 was between the uprights and below the crossbar of the goal (e.g., within a valid/legal scoring area).

In some examples, the puck 604 includes a transmitter that transmits the magnetic field measurements to a zero-crossing analyzer 638, which analyzes the magnetic field measurements to determine whether the puck 604 has crossed the first goal line 620. In some examples, the zero-crossing analyzer 638 determines a crossing of the first goal line 620 when the Z direction magnetic field $B_Z$ is zero or substantially zero (e.g., within a tolerance of zero, such as a noise tolerance or other margin to account for fluctuations caused by noise, field disturbance, orientation variations, etc.). Additionally or alternatively, a goal or crossing of a line or plane of interest may be determined based on an inflection (e.g., a flipping or reverse) of the magnitude of the Z direction magnetic field $B_Z$ such as, for example, from a positive magnitude to a negative magnitude. For example, as illustrated in the graph 300 of FIG. 3, the magnitude of the Z direction magnetic field $B_Z$ switches from a positive magnitude or strength to a negative magnitude or strength when crossing the zero-crossing plane at r/a=1. Likewise, referring back to FIG. 6, the magnetic field generated by the goal line coil 624 of FIG. 6 exhibits a positive magnitude on a first side of the first goal line 620 (e.g., towards the center of the hockey rink 602) and a negative magnitude on a second side of the first goal line 620 (towards the first end wall 608). In some examples, a plurality of measurements are recorded and an inflection is monitored for during a window of time where $B_Z(t)=0$. Additionally or alternatively, the puck 604 may include an analyzer or processor to determine whether the puck 604 has crossed the first or second goal lines 620, 622. In some examples, the puck 604 includes a memory and a clock. The processor may store a record in the memory indicating a time at which the sensor 636 detected a zero or substantially zero $B_Z$.

In some examples, the goal line coil 624 may be disposed six inches below the playing surface 606. In other examples, the goal line coil 624 may be disposed at different distances from the playing surface 606. In some examples, to install the example goal line coil 624, the goal line coil 624 is positioned on top of the supporting surface of the hockey rink 602, and then the water (to form the ice) is poured on top of the goal line coil 624. In other examples, a groove may be formed in the ice and the goal line coil 624 may be disposed in the groove and covered with water (which turns to ice) to form a substantially smooth playing surface.

As can be seen in FIG. 7, the zero-crossing plane 700 is fairly straight or planar in the vertical direction. However, the zero-crossing plane 700 begins to warp (e.g., bow or curve) a distance vertically above the goal line coil 624. Depending on the height of the goal or area needed to be tracked, a straighter zero-crossing plane may be desired (e.g., a zero-crossing plane that is substantially co-linear with the goal line for the height of the goal). For example, with other sports such as football or soccer, the ball may cross the goal line at a relatively high location.

Figure 8:
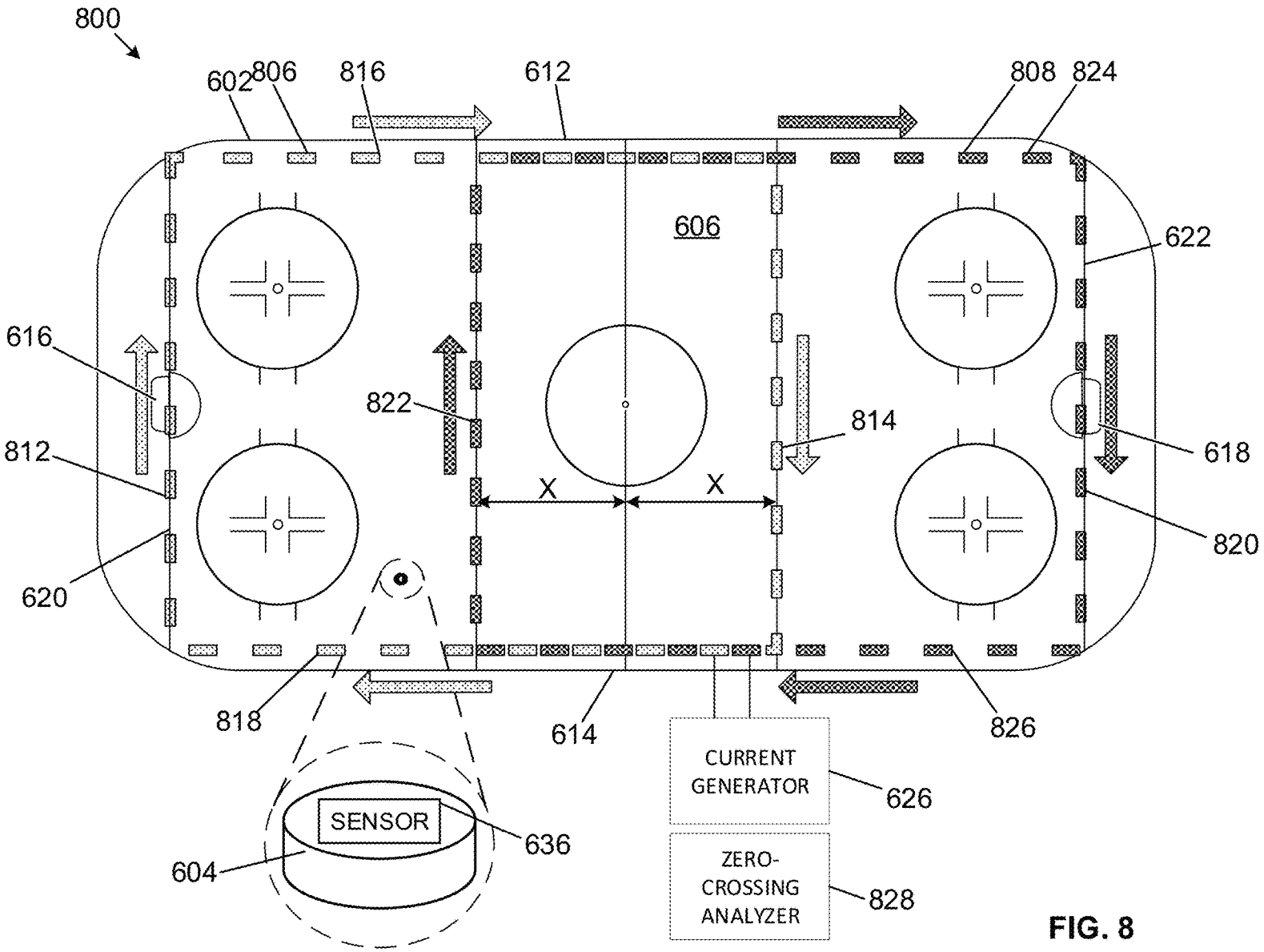
FIG. 8 illustrates another example sport tracking system, implemented in connection with the example hockey rink of FIG. 6, having multiple coils and constructed in accordance with the teachings of this disclosure.

FIG. 8 illustrates an example sport tracking system 800 constructed in accordance with the teachings of this disclosure that improves the flatness of the zero-crossing plane. In the illustrated example, the sport tracking system 800 is implemented in connection with the hockey rink 602, the puck 604 and the current generator 626, which are disclosed in connection with FIG. 6. To avoid redundancy, a description of the hockey rink 602, the puck 604 and the current generator 626 are not repeated. Instead, the interested reader is referred back to the discussion of FIG. 6 for a full written description of the hockey rink 602, the puck 604 and the current generator 626. To facilitate this process, the same references numerals are used in FIGS. 6 and 8 to refer to like parts.

To determine whether the puck 604 has crossed the first or second goal lines 620, 622 (e.g., a plane of interest) and into one of the first or second goals 616, 618, the example sport tracking system 800 of FIG. 8 includes a first goal line coil 806 and a second goal line coil 808. In the illustrated example of FIG. 8, the first and second goal line coils 806, 808 overlap in a manner such that the zero-crossing planes along the first and second goal line coils 620, 622 are less warped and, thus, relatively flat or planar in the Z direction (as disclosed in further detail herein). Similar to the goal line coil 624 of FIG. 6, the first and second goal line coils 806, 808 of the example tracking system 800 are disposed below (e.g., buried in) the playing surface 606 (e.g., beneath the ice). Additionally, the first and second goal line coils 806, 808 are oriented perpendicular to the plane of interest (i.e., vertical plane(s) positioned on top of an in alignment with the first goal line 620 and/or the second goal line 622) and, thus, the Z direction magnetic field $B_Z$ is in the vertical direction (into and out of the drawing in FIG. 8). In the illustrated example, the example sport tracking system 800 includes the current generator 626 to apply AC to the first and second goal line coils 806, 808 to generate alternating magnetic fields in the first and second goal line coils 806, 808. In some examples, the current generator 626 applies the same strength current to each of the first and second goal line coils 806, 808. In some examples, the current generator 626 generates a current in the same direction in the first and second goal line coils 806, 808.

In the illustrated example, the first goal line coil 806 and the second goal line coil 808 each include one or more sections (e.g., portions, sides) that define a loop. In particular, the first goal line coil 806 includes a first section 812, a second section 814 opposite the first section 812, a third section 816 and a fourth section 818 opposite the third section 816 that form a rectangular loop. The first section 812 of the first goal line coil 806 is aligned along the first goal line 620, similar to the goal line coil 624 disclosed in connection with FIG. 6. Thus, when the first goal line coil 806 generates a magnetic field, a zero-crossing plane is created above the first section 812 of the first goal line coil 806 along the first goal line 620. In the illustrated example, the second goal line coil 808 similarly includes a first section 820, a second section 822 opposite the first section 820, a third section 824 and a fourth section 826 opposite the third section 824 that form a rectangular loop. The first section 820 of the second goal line coil 808 is aligned along the second goal line 622. Thus, when the second goal line coil 808 generates a magnetic field, a zero-crossing plane is created above the first section 820 of the second goal line coil 808 along the second goal line 622.

To reduce the warpage (e.g., curving) of the zero-crossing planes along the first and second goal lines 620, 622, the first and second goal line coils 806, 808 are at least partially overlapped (when viewed from the top plan view). In particular, the first goal line coil 806 forms a first planar ring and the second goal line coil 808 forms a second planar ring. In some examples, the first planar ring formed by the first goal line coil 806 and the second planar ring formed by the second goal line coil 808 are substantially the same size. The first and second planar rings are offset from each other. In other words, the centers of the first and second planar rings are not aligned. As such, the first and second goal line coils 806, 808 are partially overlapped (e.g., when viewed from the top plan view, a portion of the area circumscribed by the first goal line coil 806 is within the area circumscribed by the second goal line coil 808, and vice versa). As used herein, partially overlapping excludes full overlapping (e.g., where one coil is directly above/below another coil, having the same size and same center). As a result of the partial overlapping, portions of the magnetic field generated by the first and second goal line coils 806, 808 interfere with each other to reduce the curving effect seen in a single coil system. For example, in FIG. 8, the current in the first and second goal line coils 806, 808 is flowing in the clockwise-direction (as shown by the arrows). As such, the current in the first section 820 of the second goal line coil 808 and the current in the second section 814 of the first goal line coil 806 are both moving in the same direction (down in FIG. 8; toward the second side wall 614). As a result, the magnetic fields generated by these sections 814, 820 affect the magnetic field generated by the current in the first section 812 of the first goal line coil 806, which is moving in the opposite direction (up in FIG. 8; toward the first side wall 612). However, the second section 822 of the second goal line coil 808 is disposed between (1) the first section 820 of the second goal line coil 808 and (2) the first section 812 of the first goal line coil 806. In this manner, the magnetic field generated by the second section 822 of the second goal line coil 808 helps block or cancel out some of the magnetic field effects from the first section 820 of the second goal line coil 808 and the second section 814 of the first goal line coil 806. Thus, the zero-crossing plane generated along the first section 812 of the first goal line coil 806 is warped less (e.g., is flatter or straighter) than it would be with a single coil system. In other words, the vertical component of the magnetic field created by the first goal line coil 806 along the first goal line 620 is less bowed. Similarly, the vertical component of the magnetic field created by the second goal line coil 808 along the second goal line 622 is less bowed.

Figure 9:
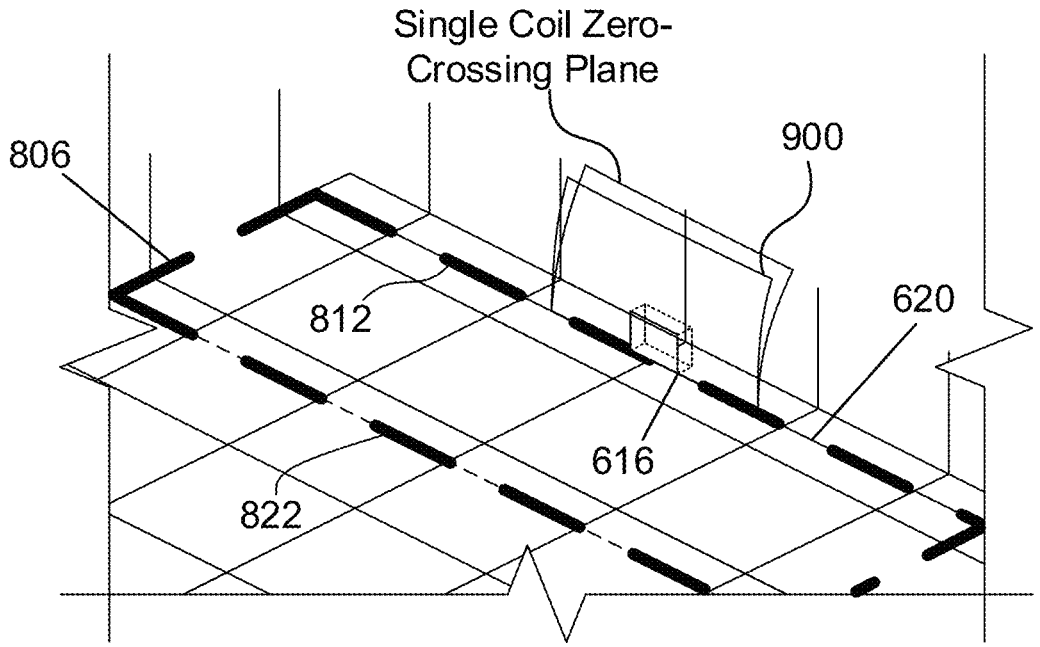
FIG. 9 illustrates an example zero-crossing plane generated by the example coils of the example sport tracking system of FIG. 8.

For example, FIG. 9 illustrates a portion of a zero-crossing plane 900 created above the first section 812 of the first goal line coil 806. As can be seen from FIG. 9, the zero-crossing plane 900 is substantially vertical along the first goal line 620 from a bottom to a top of the first goal 616. As described above, the second section 822 of the second goal line coil 808 blocks some of the magnetic field that would otherwise cause the zero-cross plane 900 to bow or curve. Also illustrated in FIG. 9 is a zero-cross plane generated by a single coil (such as the zero-crossing plane 700 of FIG. 7). As can be seen in FIG. 9, the zero-crossing plane 900 generated by the two-coil arrangement is curved a smaller distance from vertical than the zero-crossing plane generated by a single coil arrangement. Thus, the zero-crossing plane 900 can be used to more accurately determine a crossing of a plane of interest at higher distances/height from the coil than the zero-crossing plane generated by a single coil.

Referring back to FIG. 8, the arrangement between the first and second goal line coils 806, 808 also creates a similar effect on the zero-crossing plane generated by the first section 820 of the second goal line coil 808 along the second goal line 622. Thus, the two interleaved coils of the example sport tracking system 800 of FIG. 8 achieve zero-crossing planes that are flatter or more planar than the single coil arrangement of FIG. 6. When the puck 604 crosses one of the zero-crossing planes, the sensor 636 in the puck 604 detects the Z direction magnetic field $B_Z$ as zero (or substantially zero) and, thus, may be used to determine a goal has occurred. In some examples, the puck 604 includes a transmitter that transmits the magnetic field measurements to a zero-crossing analyzer 828, which analyzes the magnetic field measurements to determine whether the puck 604 crossed the zero-crossing planes of the first or second goal line coils 806, 808 and, thus, the first or second goal lines 620, 622, similar to the zero-crossing analyzer 638 of FIG. 6.

In some examples, the size (e.g., diameter) of the first and second goal line coils 806, 808 is the same and the coils are placed to symmetrically interleave (e.g., by overlapping a same distance), which enables the first and second goal line coils 806, 808 to have a mutually beneficial effect on each other. In the illustrated example, the second section 814 of the first goal line coil 806 and second section 822 of the second goal line coil 808 are spaced from a center of the hockey rink 602 by a same distance X (e.g., in a symmetrically interleaved manner). In other examples, the second section 814 of the first goal line coil 806 and second section 822 of the second goal line coil 808 may be spaced from the center of the hockey rink 602 by different distances (e.g., not symmetrically interleaved).

Figure 10:
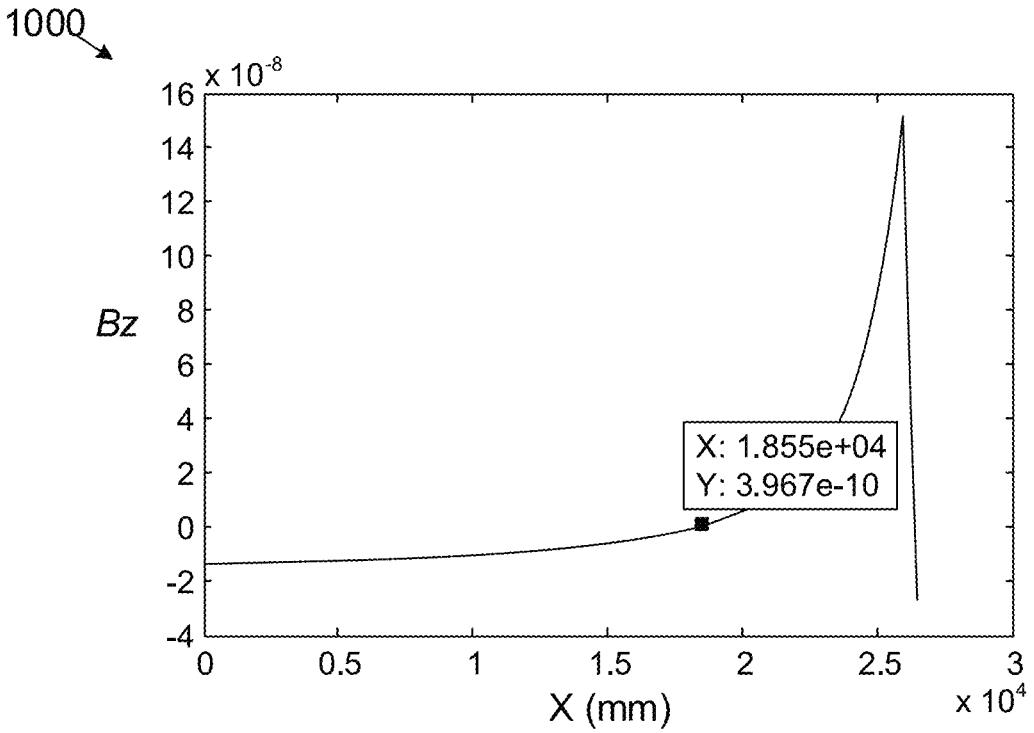
FIG. 10 is an example graph illustrating the magnetic field generated by the example coils of FIG. 8 at different distances from each other.
Figure 11:
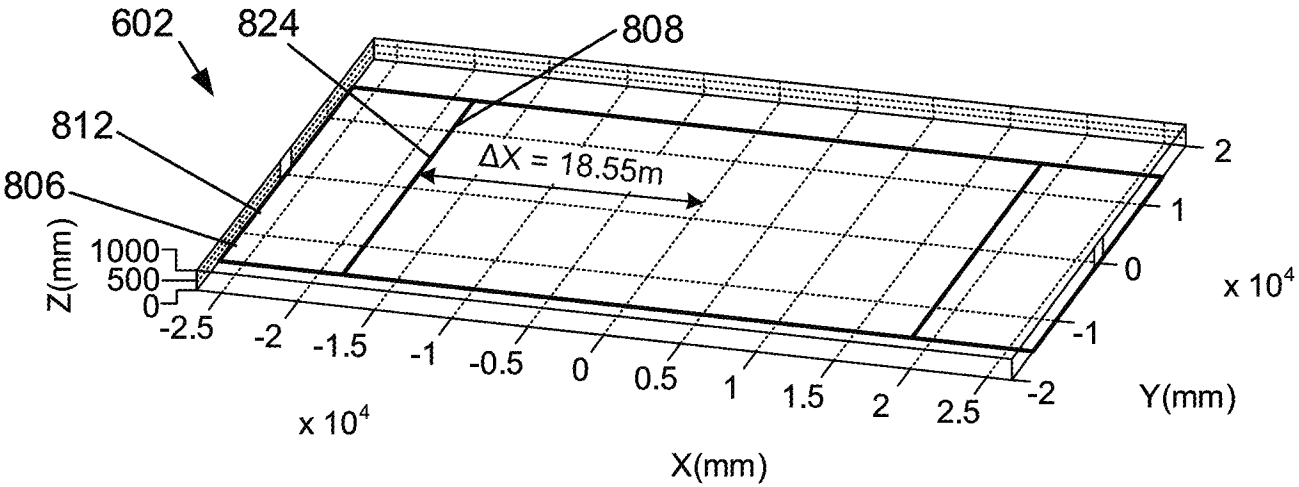
FIG. 11 illustrates the example sport tracking system of FIG. 8 in which the arrangement of the example coils has optimized.

The amount of overlap and/or distance between the sections of the first and second goal line coils 806, 808 can be changed to optimize the flatness of the zero-crossing planes. For example, FIG. 10 is an example graph 1000 illustrating the $B_Z$ distribution along the first goal line 620 (e.g., above the first section 812 of the first goal line coil 806) versus the distance X between the center of the hockey rink 602 and the second section 822 of the second goal line coil 808. As shown, the Z direction magnetic field $B_Z$ is zero or substantially zero (Y=3.967e-10 Tesla (T)) at a distance X of 18,550 mm (or 18.55 m). At distances greater than or less than X=18,500 mm, the Z direction magnetic field $B_Z$ is positive or negative. As such, the distance X between the center of the hockey rink 602 and the second section 822 of the second goal line coil 808 can be optimized, as illustrated in FIG. 11, where the second section 822 of the second goal line coil 808 is 18.55 m from the center of the hockey rink 602. At this distance, the arrangement produces an optimal zero-crossing plane at the first section 812 of the first goal line coil 806 and, thus, along the plane of interest.

Figure 12A:
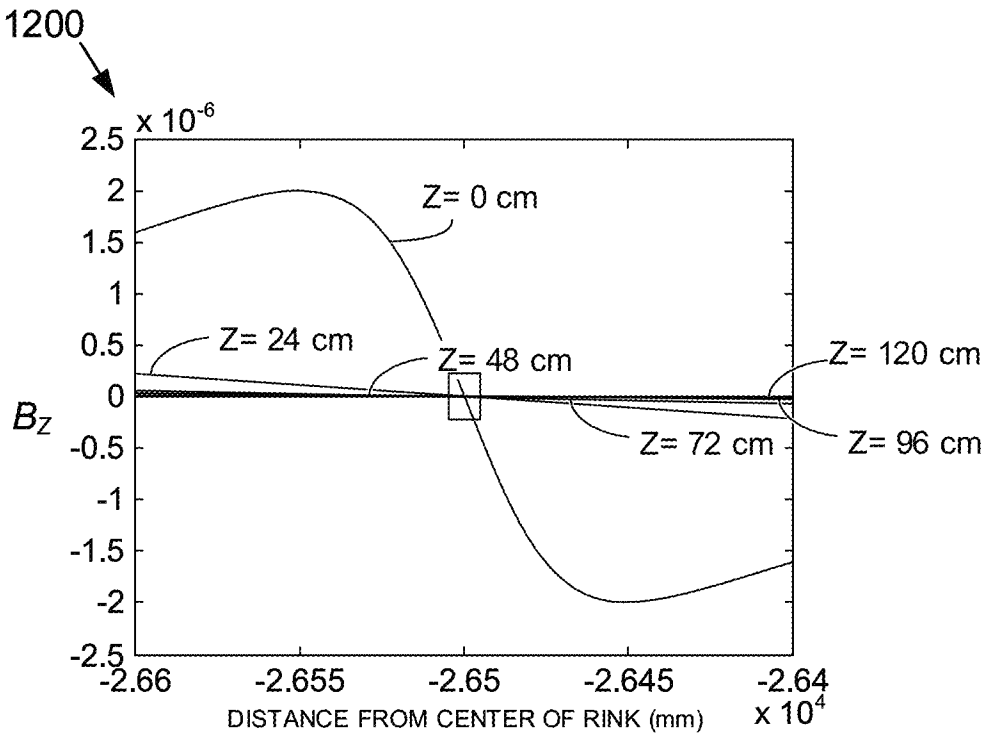
FIG. 12A is an example graph illustrating a strength of the magnetic field generated by one of the example coils of FIG. 8 at different distances from the coil.
Figure 12B:
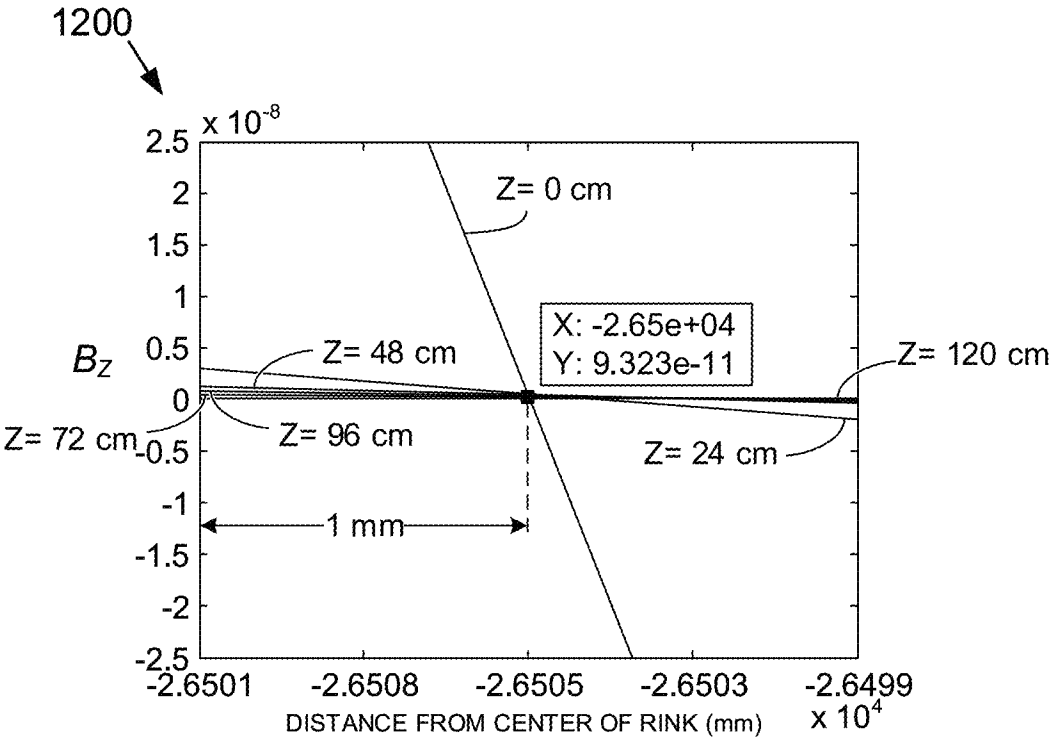
FIG. 12B is an enlarged portion of the example graph in FIG. 12A.

FIG. 12A is an example graph 1200 illustrating the Z direction magnetic field $B_Z$ produced by the first goal line coil 806 versus the distance from the center of the hockey rink 602. The first goal line 620 is 26.5 m from the center of the hockey rink 602. The graph 1200 includes a plurality of lines representing the measured Z direction magnetic field $B_Z$ at different heights z from the ice. FIG. 12B is an enlarged view of the portion circumscribed by a rectangle in FIG. 12A. As illustrated, the Z direction magnetic field $B_Z$ drops to zero at the first goal line 620 (i.e., at 26.5 m) for all measured heights (z). Thus, the zero-crossing plane generated by the first goal line coil 806 is substantially flat or straight along the entire height of the goal (e.g., 1.2 m) and, thus, can be used to accurately determine a crossing at any height in the 1.2 m goal. Further, as illustrated in FIG. 12B, a measurable Z direction magnetic field $B_Z$ can be detected only a small distance (e.g., 1 mm) from the first goal line 620. Thus, the example sport tracking system 800 can be used to measure the location of an object of interest (e.g., the puck 604) within a very small distance (e.g., 1 mm or less) of a plane of interest (e.g., the first goal line 620) and, thus, achieves better accuracy than known tracking systems.

Figure 13A:
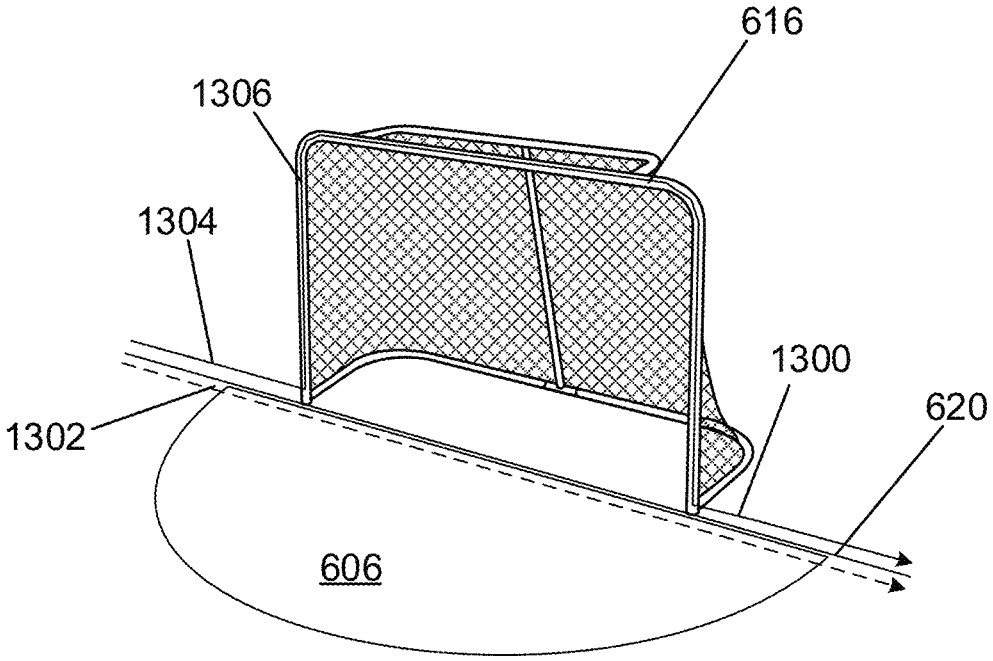
FIG. 13A illustrates an example hockey goal of the example sport tracking system of FIG. 6 in which a turn of an example coil is routed around a frame of the example hockey goal.

While in the illustrated examples of FIGS. 6 and 8 the coils are embedded or buried in the playing surface of the hockey rink 602, in other examples at least a portion of a coil may be disposed above the playing surface, which may increase the detectable strength of the magnetic field generated by the coils. For example, FIG. 13A illustrates the first example goal 616 as disclosed in connection with FIG. 6. In the illustrated example, a coil 1300 is disposed along the first goal line 620. The example coil 1300 may correspond to any of the goal line coils 624, 806, 808 disclosed in connection with FIGS. 6 and 8. In the illustrated example, the coil 1300 includes a first turn 1302 and a second turn 1304. The first turn 1302 is disposed below the playing surface 606, and a portion of the second turn 1304 is routed up and around a frame 1306 (e.g., including the uprights and cross-bar) of the first goal 616. This configuration creates a stronger magnetic field (e.g., a larger amplitude) in the coil 1300 near the top of the goal 616 adjacent, but not in, the plane of interest. The magnetic field $B_Z$ measurement within the plane of interest remains at or near zero. As a result, the difference between the magnetic field $B_Z$ in front of the first goal 616 and the magnetic field $B_Z$ along the first goal line 620 (e.g., the plane of interest) is more distinct (e.g., more easily measured or detected).

Figure 13B:
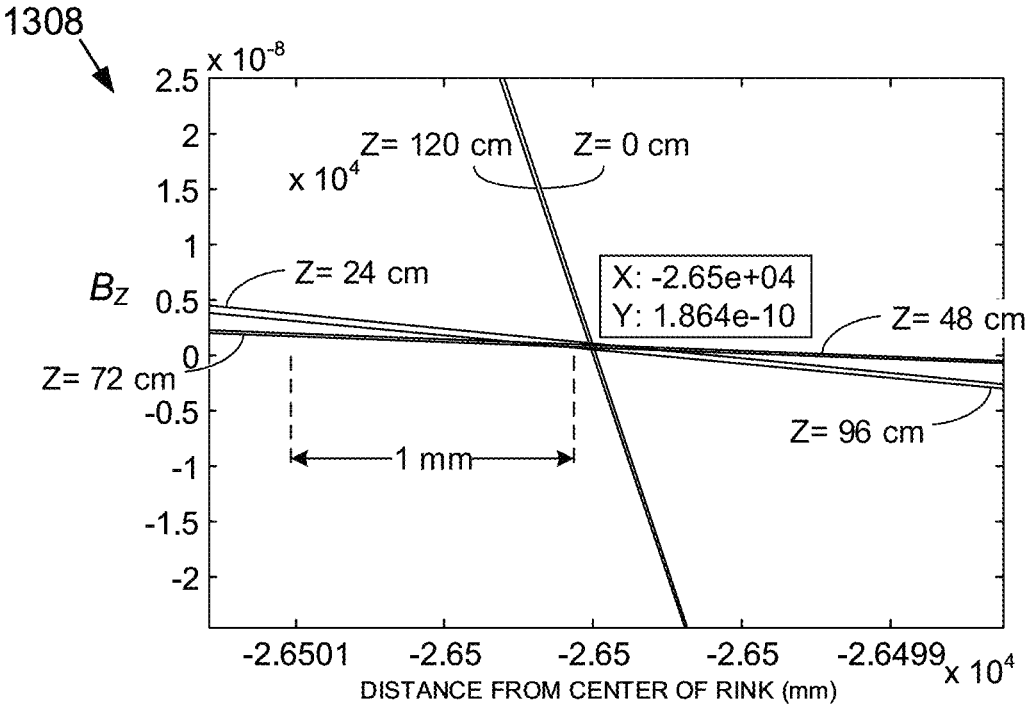
FIG. 13B is an example graph illustrating a strength of the magnetic field generated by the example coil of FIG. 13A.

FIG. 13B is an example graph 1308 illustrating the Z direction magnetic field $B_Z$ produced by the coil 1300 of FIG. 13A versus the distance from the center of the hockey rink 602 (where the first goal line 620 is 26.5 m from the center of the hockey rink 602). The graph 1308 includes a plurality of lines representing the measured Z direction magnetic field $B_Z$ at heights z from the ice. As illustrated, the Z direction magnetic field $B_Z$ drops to zero at the first goal line 620 (i.e., at 26.5 m) for all z heights. Additionally, the amplitude of the Z direction magnetic field $B_Z$ is relatively large (compared to the graph 1200 in FIG. 12, for example) at 1 mm in either direction. Thus, the example coil configuration of FIG. 13A produces a strong magnetic field difference between the zero-crossing plane and adjacent planes, which can be used to help determine a crossing of a zero-crossing plane.

Figure 14:
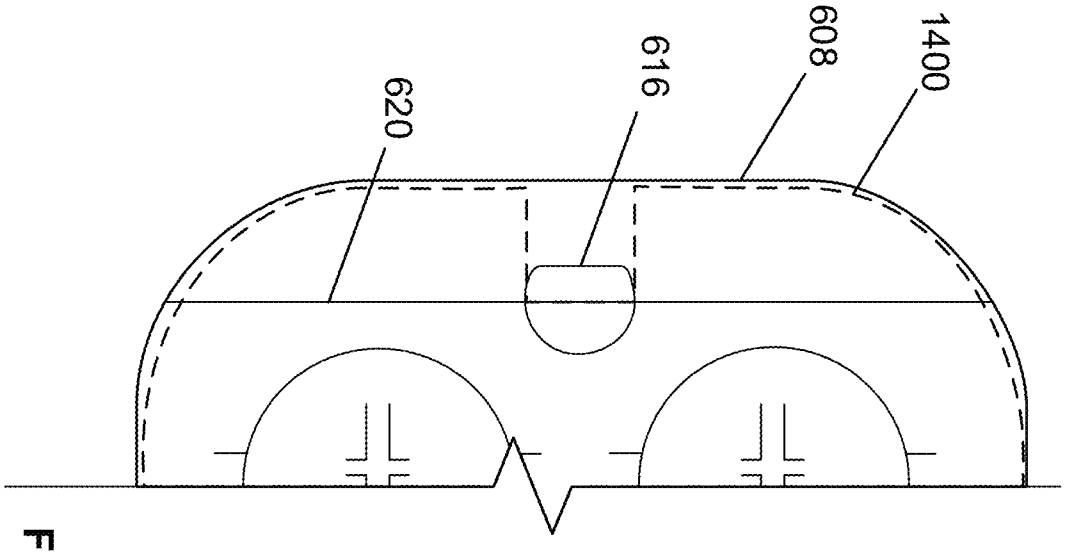
FIG. 14 illustrates an example hockey goal of the example sport tracking system of FIG. 6 having an example coil with a different shape than the example coil of FIG. 6.

In the illustrated examples of FIGS. 6 and 8, the crossing of a zero-crossing line generated by the goal line coil may not necessarily mean a goal, because the goal line coils extend along the goal lines beyond the edges of the first and second goals 616, 618. As such, in some examples, a visual confirmation may be used to confirm whether the crossing occurred between the uprights and below the crossbar of the goal. In other examples, the goal line coils may have different shapes. For example, FIG. 14 illustrates an example showing a goal line coil 1400, which may be used to implement the example goal line coil 624 of FIG. 6. The goal line coil 1400 extends along the first goal line 620 along a section of the first goal line 620 between the uprights of the first goal 616. The goal line coil 1400 extends back towards the first end wall 608. As such, a zero-crossing plane is only generated along the first goal line 620 along the opening of the first goal 616 (e.g., the plane of interest) and not along the entire length of the first goal line 620. In this example, it may be easier to determine a goal based on the crossing, because the crossing of the zero-crossing plane is likely a goal (unless the puck 604 is above the first goal 616 or behind the first goal, which is easily confirmed by visuals). In other examples, the goal line coil 1400 may disposed in other locations and/or be configured in other shapes. In some examples, the goal line coil 1400 may be disposed at different depths (e.g., along the Z or vertical axis). For example, the portion of the goal line coil 1400 along the first goal line 620 may be six inches below the ice, while the rest of the goal line coil 1400 may be two feet below the ice, which may help distinguish the desired zero-crossing plane across the front of the first goal 616 from other sections of the goal line coil 1400.

As illustrated in the example sport tracking systems 600, 800 of FIGS. 6 and 8, the puck 604 includes one or more sensors 636 to detect the magnetic field generated by the coils. In some examples, the sensor 636 may be implemented by receiver coils. When a receiver coil is in the presence of an alternating magnetic field (such as generated by the goal line coil 624 of FIG. 6), a voltage is induced in the receiver coil, which can be indicative of the direction, strength, and/or presence of the magnetic field. For a two coil arrangement having the same normal direction of magnetic field (such as the sport tracking system 800 of FIG. 8), the induced voltage Von a receiver coil is given by Equation 3 below.

$$V=2\pi fQ\cdot B_Z\times A_0\cdot N=2\pi fS\cdot B_Z\times A_0 \qquad \text{Equation 3}$$

In Equation 3, Q is the quality factor of the receiver coil, $B_Z$ is the Z direction magnetic field generated by a transmitter coil (e.g., the first and second goal line coils 806, 808), f is the frequency of the magnetic field, A is the area of the receiver coil, and N is the number of turns of the receiver coil. In most sports, the orientation of the sport implement (e.g., a football, a hockey puck, etc.) is not fixed during game play. As such, example receiver coils disclosed herein may include three spatially co-located orthogonal coils to separate out these different magnetic field components ($B_X$, $B_Y$, $B_Z$). In some examples, the three coils have similar magnetic field sensitivity S, which is given by Equation 4 below.

$$S = Q\cdot N\left(\frac{V}{\text{Tesla}}\right) \qquad \text{Equation 4}$$

Figure 15:
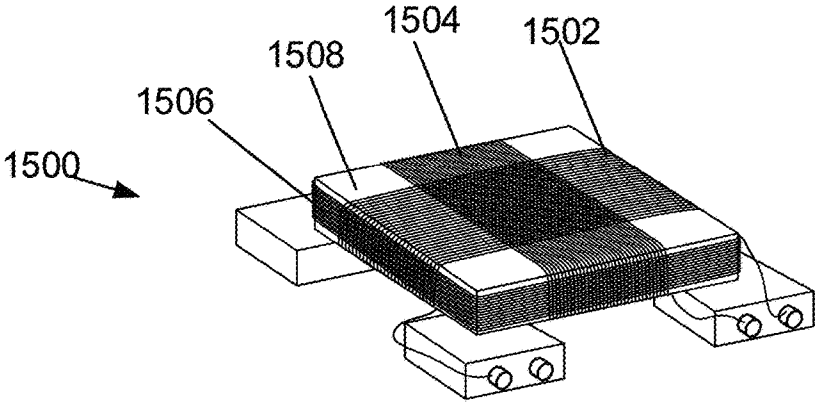
FIG. 15 illustrates an example receiver coil that may be implemented in an example sport implement and constructed in accordance with the teachings of this disclosure.
Figure 16:
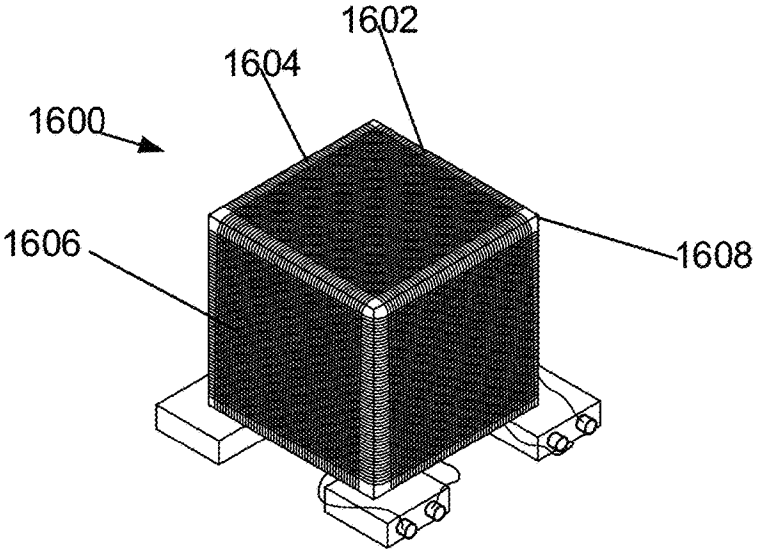
FIG. 16 illustrates another example receiver coil that may be implemented in an example sport implement and constructed in accordance with the teachings of this disclosure.
Figure 17:
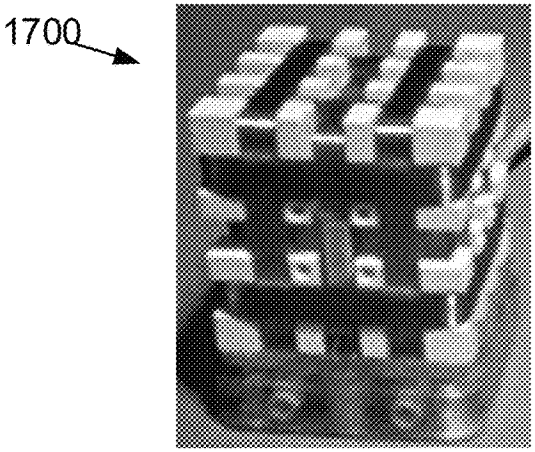
FIG. 17 illustrates another example receiver coil that may be implemented in an example sport implement and constructed in accordance with the teachings of this disclosure.

FIGS. 15, 16 and 17 illustrate example receiver coils that may be implemented in any of the example sport implements (e.g., the puck 604) disclosed herein and/or any other object of interest. The example receiver coil 1500 of FIG. 15 includes a first coil 1502, a second coil 1504 and a third coil 1506 that are orthogonal to each other. The first, second and third coils 1502, 1504, 1506 are wound around a ferrite core 1508 and achieve 3D coverage along the three major axes (X, Y, Z). In the illustrated example, the receiver coil 1500 is asymmetric. In particular, the first and second coils 1502, 1504 form smaller openings than the third coil 1506. As such, the example receiver coil 1500 is compact or small and can be implemented in relatively small sport implements (e.g., a hockey puck, a lacrosse ball, etc.) and/or other objects of interest.

FIG. 16 illustrates another example receiver coil 1600. Similar to the receiver coil 1500 in FIG. 15, the example receiver coil 1600 of FIG. 16 includes a first coil 1602, a second coil 1604 and a third coil 1606 wound around a ferrite core 1608 and oriented orthogonal to each other to cover the three major axes. In the illustrated example, the receiver coil 1600 is symmetric. In particular, the first, second and third coils 1602, 1604, 1606 are substantially the same size and define or form a cube. In some examples, symmetrical configurations have more uniform sensitivity S in the coils than asymmetrical configurations.

FIG. 17 illustrates another example receiver coil 1700. The example receiver coil 1700 of FIG. 17 is a Maxwell coil, which captures the magnetic field along a relatively straight line (e.g., one component of the magnetic field). In other examples, other types of coils may be implemented, such as a Helmholtz coil.

An example process to calculate the Z direction magnetic field $B_Z$ from a receiver coil is described below in connection with the example receiver coil 1600 of FIG. 16. However, the example process can likewise be applied to the receiver coils 1500, 1700 of FIGS. 15 and 17 and/or any other receiver coil having three orthogonal coils.

In some examples, the orientation of the receiver coil 1600 is needed to solve for the three magnetic field components ($B_X$, $B_Y$, $B_Z$) from the voltages from the three orthogonal receiver coils (e.g., the first, second and third coils 1602, 1604, 1606). In some examples, the orientation of the receiver coil 1600 is determined by a gyro sensor (e.g., a gyrometer). For example, the sport implement and/or object of interest may include an integrated gyrometer. Additionally or alternatively, the orientation of the receiver coil 1600 may be determined through magnetic field calibration (discussed in further detail herein).

Figure 18:
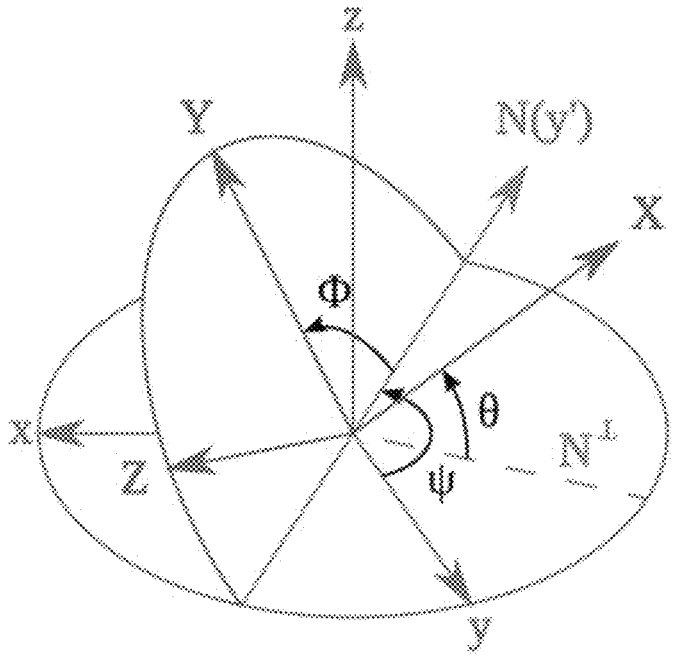
FIG. 18 illustrate example directions used to determine an orientation of a receiver coil.
Figure 19:
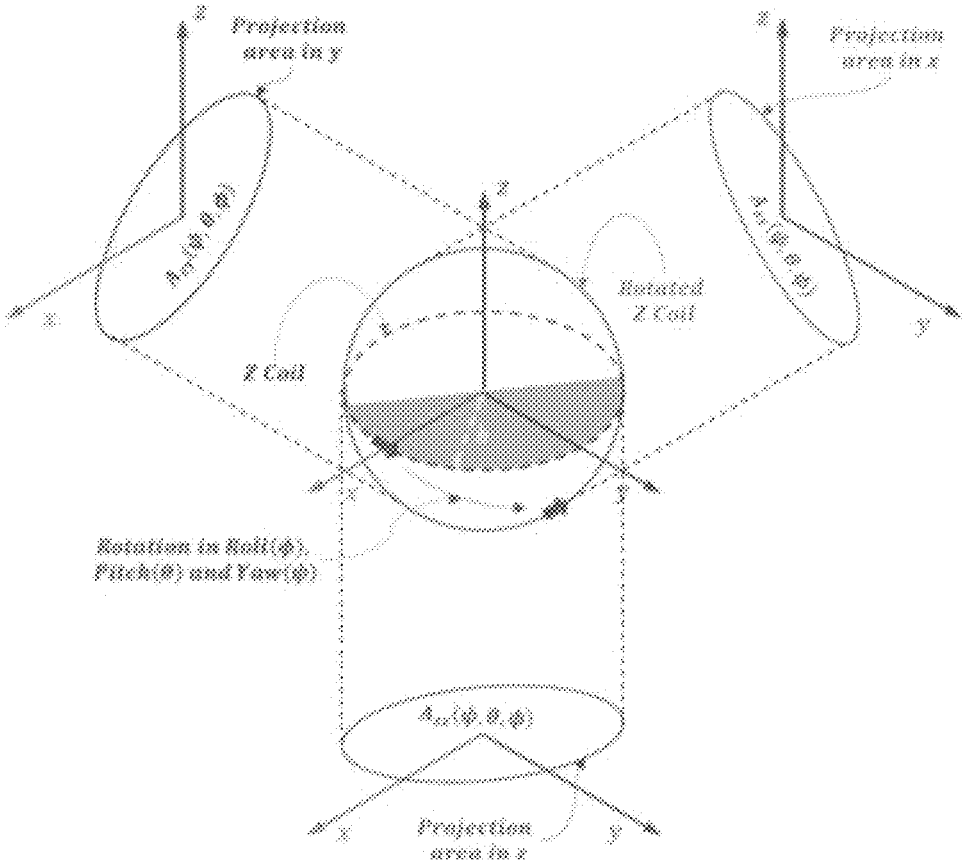
FIG. 19 illustrates projections of an example receiver coil used to determine different magnetic field components.

As illustrated in FIG. 18, the orientation of a receiver coil (e.g., the receiver coil 1600) may be defined using rotation along three axes (z-, y', x"), namely, roll (represented as Φ), pitch (represented as θ) and yaw (represented as Ψ). FIG. 19 illustrates the projection area of a single coil onto the three major planes (x-y, y-z and y-x), which can be calculated using Equation 5 below.

$$A = \begin{bmatrix} A_{XX} & A_{YX} & A_{ZX} \\ A_{XY} & A_{YY} & A_{ZY} \\ A_{XZ} & A_{ZZ} & A_{ZZ} \end{bmatrix} = \pi b^2 \begin{bmatrix} \cos\Psi\cos\theta & \begin{matrix}\cos\Psi\sin\theta\sin\Phi - \\ \cos\Phi\sin\Psi\end{matrix} & \begin{matrix}\sin\Psi\sin\Phi + \\ \cos\Psi\cos\Phi\sin\theta\end{matrix} \\ \cos\theta\sin\Psi & \begin{matrix}\cos\Psi\cos\Phi + \\ \sin\Psi\sin\theta\sin\Phi\end{matrix} & \begin{matrix}\cos\Phi\sin\Psi\sin\theta - \\ \cos\Psi\sin\Phi\end{matrix} \\ -\sin\theta & \cos\theta\sin\Phi & \cos\theta\cos\Phi \end{bmatrix} \quad \text{Equation 5}$$

In Equation 5, b is the radius of the circular receiver coil. As illustrated in FIG. 19, $A_{ZY}$ is the projection area of the Z direction coil (e.g., the third coil 1606 (FIG. 6)) (on the x-y plane, z as normal direction) onto the x-z plane. With these definitions, the relationship between measured voltage and the orientation of the coil can be derived using Equation 6 below:

$$V = [\,V_X \quad V_Y \quad V_Z\,] = 2\pi f S \cdot B \times A = 2\pi f S \cdot [\,B_X \quad B_Y \quad B_Z\,] \times \begin{bmatrix} A_{XX} & A_{YX} & A_{ZX} \\ A_{XY} & A_{YY} & A_{ZY} \\ A_{XZ} & A_{ZZ} & A_{ZZ} \end{bmatrix} \quad \text{Equation 6}$$

where $V_X$, $V_Y$, $V_Z$ represents the measured voltages from the three orthogonal coils, and $B_X$, $B_Y$, $B_Z$ are the three components of unknown magnetic field generated by a coil (e.g., the goal line coil goal line 624 of FIG. 6). In other words, Equation 6 takes the cross product of the magnetic field in space and the projection matrix to determine the three voltages $V_X$, $V_Y$, $V_Z$. Then, using the three voltages $V_X$, $V_Y$, $V_Z$ and the projection matrix, the three magnetic field components $B_X$, $B_Y$, $B_Z$ can be solved for using Equation 7 below.

$$[\,B_X \quad B_Y \quad B_Z\,] = \frac{1}{2b^2\pi^2 f S} \cdot [\,V_X \quad V_Y \quad V_Z\,] \times \begin{bmatrix} \cos\Psi\cos\theta & \begin{matrix}\cos\Psi\sin\theta\sin\Phi - \\ \cos\Phi\sin\Psi\end{matrix} & \begin{matrix}\sin\Psi\sin\Phi + \\ \cos\Psi\cos\Phi\sin\theta\end{matrix} \\ \cos\theta\sin\Psi & \begin{matrix}\cos\Psi\cos\Phi + \\ \sin\Psi\sin\theta\sin\Phi\end{matrix} & \begin{matrix}\cos\Phi\sin\Psi\sin\theta - \\ \cos\Psi\sin\Phi\end{matrix} \\ -\sin\theta & \cos\theta\sin\Phi & \cos\theta\cos\Phi \end{bmatrix}^{-1} \quad \text{Equation 7}$$

Thus, with historic information (e.g., repeated measurements) of calculated $B_Z$ from the three coil voltage measurement, the crossing of a zero-crossing plane can be detected and, thus, the crossing of a plane of interest (e.g., a goal line) can be detected. In some examples, a goal or crossing of a line or plane of interest is determined when the Z direction magnetic field $B_Z$ is zero or substantially zero (e.g., within a tolerance of zero, such as a noise tolerance or other margin to account for fluctuations caused by noise, field disturbance, orientation variations, etc.). Additionally or alternatively, a goal or crossing of a line or plane of interest may be determined based on an inflection (e.g., a flipping or reverse) of the magnitude of the Z direction magnetic field $B_Z$ such as, for example, from a positive magnitude to a negative magnitude. For example, as illustrated in the graph 300 of FIG. 3, the magnitude of the Z direction magnetic field $B_Z$ switches from a positive magnitude or strength to a negative magnitude or strength when crossing the zero-crossing plane at r/a=1. This inflection point can also be see in FIGS. 12A and 12B. In other words, the magnetic field generated by a goal line coil (e.g., the goal line coil 624 of FIG. 6) exhibits a positive magnitude on a first side of a line or plane of interest and a negative magnitude on a second side of the line or plane of interest. In some examples, a plurality of measurements are recorded and an inflection is monitored for during a window of time where $B_Z(t)=0$.

In some examples, the orientation of a sport implement and/or object of interest is determined using a magnetic field measurement. For example, a calibration coil with a known field distribution may be disposed near or around the plane of interest (e.g., near the goal line). As the sport implement and/or object of interest passes through the magnetic field generated by the calibration coil, the three measurements of the known magnetic field are carried out by the 3D orthogonal coils (using the equations above) and, thus, the orientation of the sport implement and/or object of interest can be calculated.

Figure 20:
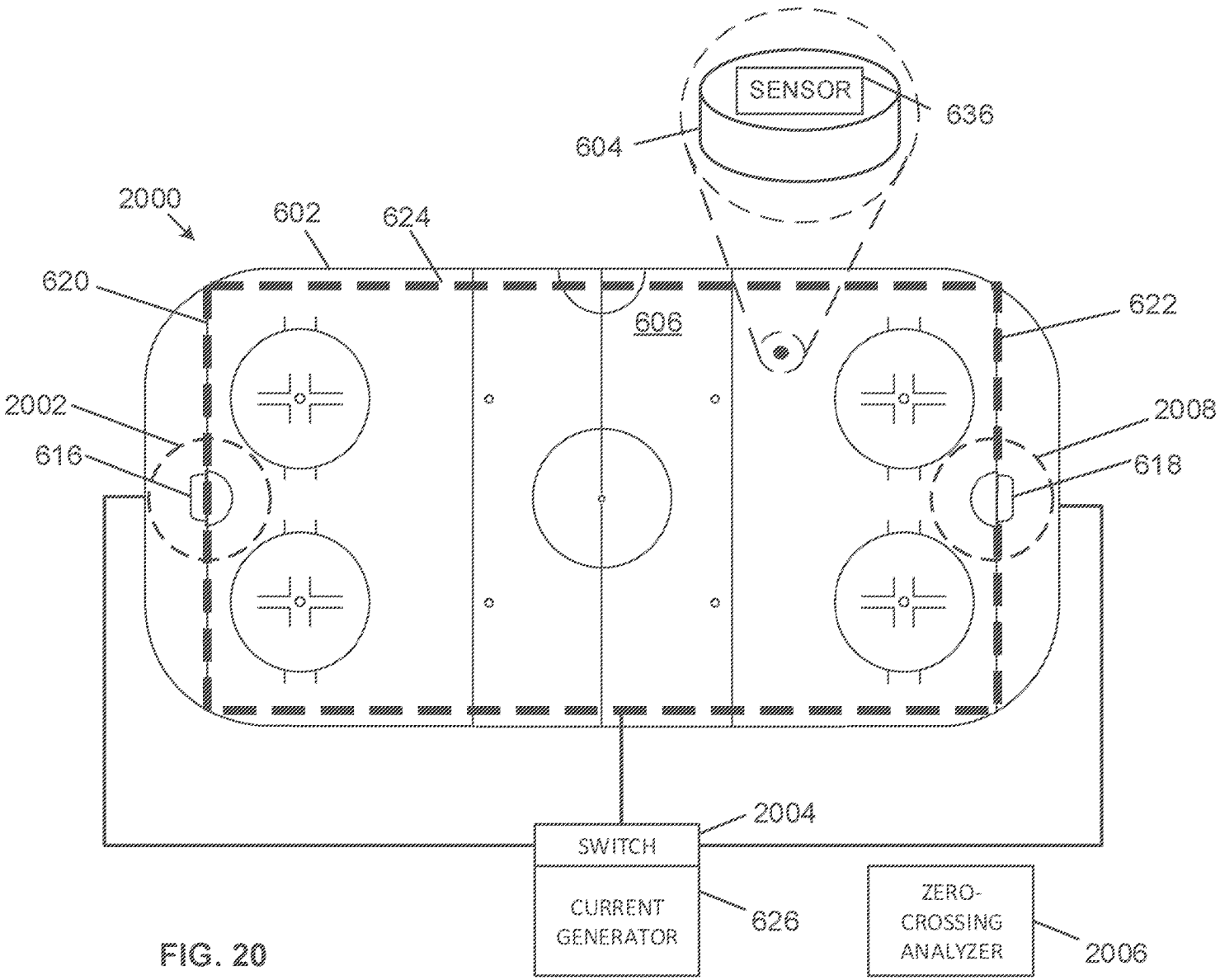
FIG. 20 illustrates an example sport tracking system, implemented in connection with the example hockey rink of FIG. 6, having a calibration coil and constructed in accordance with the teachings of this disclosure.

FIG. 20 illustrates an example sport tracking system 2000 constructed in accordance with the teachings of this disclosure that includes a calibration coil to determine an orientation of a sport implement and/or object of interest. In the illustrated example, the sport tracking system 2000 is implemented in connection with the hockey rink 602, the puck 604, the goal line coil 624 and the current generator 626, which are disclosed in connection with FIG. 6. To avoid redundancy, a description of the hockey rink 602, the puck 604, the goal line coil 624 and the current generator are not repeated. Instead, the interested reader is referred back to the discussion of FIG. 6 for a full written description of the hockey rink 602, the puck 604, the coil goal line 624 and the current generator 626. To facilitate this process, the same references numerals are used in FIGS. 6 and 20 to refer to like parts.

To determine an orientation of the puck 604 at or near the first goal 616, the example sport tracking system 2000 includes a first calibration coil 2002 (e.g., an orientation coil). As described above, in some examples, the orientation of the puck 604 is needed to calculate the Z direction magnetic field $B_Z$ experienced by the three orthogonal receiver coils. In the illustrated example, the first calibration coil 2002 is a circular coil disposed around a portion of the first goal line 620, which corresponds to the plane of interest. In the illustrated example, the first calibration coil 2002 is disposed below (e.g., buried in) the playing surface 606 (e.g., below the ice) and circumscribes the first goal 616. The first calibration coil 2002 generates a magnetic field (e.g., a reference magnetic field; a known field), which can be used to determine an orientation of the puck 604 as the puck 604 approaches the first goal line 620 and, thus, before crossing the zero-crossing plane generated by the first section 628 of the goal line coil 624. In some examples, the first calibration coil 2002 is switched off after the orientation of the puck 604 is calculated, and the goal line coil 624 is switched on, as explained in further detail herein.

In the illustrated example, the current generator 626 is electrically coupled to the first calibration coil 2002 via a switch 2004. The switch 2004 operates to apply current (from the current generator 626) to the goal line coil 624 and/or the first calibration coil 2002. As such, the current generator 626 may apply an AC signal to the first calibration coil 2002, which generates an alternating magnetic field through the first calibration coil 2002. The magnetic field B, which is primarily in the Z direction, is given by Equation 8 below.

$$B = [B_X \quad B_Y \quad B_Z] = \frac{\mu_0 I a^2}{4(x^2+y^2+z^2)^{5/2}} \times [3xz \quad 3yz \quad 2z^2 - x^2 - y^2] \approx \frac{\mu_0 I a^2}{2z^3} \cdot [0 \quad 0 \quad 1] \qquad \text{Equation 8}$$

In Equation 8, z is the vertical separation between a center of a coil (e.g., the receiver coil 1500 of FIG. 15, the receiver coil 1600 of FIG. 16 or the receiver coil 1700 of FIG. 17) inside the puck 604 and a center of the first calibration coil 2002 (which is disposed beneath the ice), I is the current flowing through the first calibration coil 2002, a is the radius of the first calibration coil 2002, and $\mu_0$ is the permeability constant. The orientation of the puck 604 can be solved with Equation 9 below using the measured voltage information from the 3D orthogonal coils inside the puck 604.

$$V = [V_X \quad V_Y \quad V_Z] = 2\pi f S \cdot B \times A = \frac{\pi f S \mu_0 I a^2}{z^3} \cdot [A_{xz} \quad A_{yz} \quad A_{zz}] = \frac{\pi f S \mu_0 I a^2}{z^3} \cdot [-\sin\theta \quad \cos\theta\sin\Phi \quad \cos\theta\cos\Phi] \qquad \text{Equation 9}$$

In some examples, the puck 604 transmits voltage measurements induced in the receiver coils to a zero-crossing analyzer 2006, which calculates or determines the orientation of the puck 604. In other examples, the orientation may be calculated by a processor in the puck 2002.

In some examples, the first calibration coil 2002 is first used to determine the orientation of the puck 604, then the first calibration coil 2002 is turned off and the goal line coil 624 is turned on (via the switch 2004), such that the sensor 636 in the puck 604 can detect when the puck 604 crosses the zero-crossing plane along the first goal line 620. In some examples, the zero-crossing analyzer 2006 controls the switch 2004. In other words, the zero-crossing analyzer 2006 controls the position of the switch 2004 to switch application of electrical current between the goal line coil 624 and the first calibration coil 2002. For example, the zero-crossing analyzer 2006 may control the switch 2004 to energize the first calibration coil 2002. Once the orientation of the puck 604 is known, the zero-crossing analyzer 2006 controls the switch 2004 to de-energize the first calibration coil 2002 and energize the goal line coil 624. Then, the Z magnetic field $B_Z$ generated by the goal line coil 624 is measured in the puck 602 to determine when the puck 602 crosses the zero-crossing plane along the first goal line 620.

In the illustrated example, the sport tracking system 2000 also includes a second calibration coil 2008 around the second goal 618, which operates substantially the same as the first calibration coil 2002. In other examples, the sport tracking system 2000 may only have one calibration coil or may have more than two calibration coils.

Figure 21:
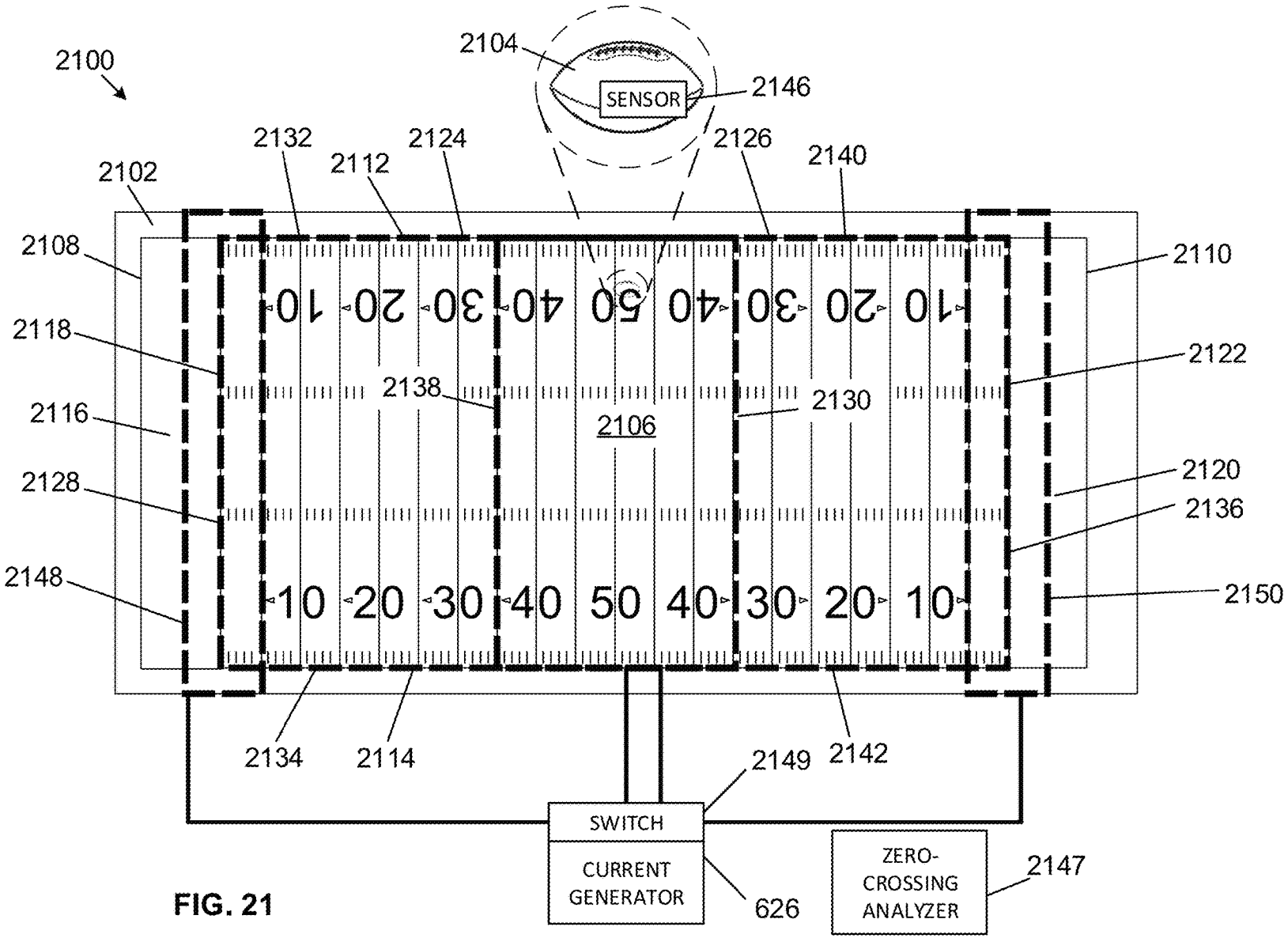
FIG. 21 illustrates an example sport tracking system, implemented in connection with an example American style football field, and constructed in accordance with the teachings of this disclosure.

While the example sport tracking systems 600, 800 and 2000 of FIGS. 6, 8 and 20 are described in connection with a hockey rink, the example systems disclosed herein may be implemented for use with other sports as well. For example, FIG. 21 illustrates an example tracking system 2100 constructed in accordance with the teachings of this disclosure. The example tracking system 2100 is implemented in connection a football field 2102 and a football 2104. The football field 2102 includes a playing surface 2106 (e.g., grass, turf, etc.) defined by a first end line 2108 and a second end line 2110 opposite the first end line 2108 (which form a length of the football field 2102), and a first side line 2112 and a second side line 2114 opposite the first side line 2112 (which form a width of the football field 2102). The football field 2102 includes a first end zone 2116 defined between a first goal line 2118 and the first end line 2108. Generally, during play, a touchdown (e.g., a goal) is scored when a player carries the football 2104 across the first goal line 2118 into the first end zone 2116 or the football 2104 is passed (across the first goal line 2118) and caught by a player in the first end zone 2116. Thus, the first goal line 2118 forms a plane of interest (e.g., a vertical plane of interest) along the width of the football field 2102 between the first side line 2112 and the second side line 2114. Similarly, the football field 2102 includes a second end zone 2120 defined between a second goal line 2122 (e.g., a plane of interest) and the second end line 2110.

To determine whether the football 2104 has crossed the first or second goal lines 2118, 2122, the example sport tracking system 2100 includes a first goal line coil 2124 and a second goal line coil 2126 (e.g., transmitter coils). In the illustrated example, the first and second goal line coils 2124, 2126 are arranged similarly to the two coil arrangement disclosed in connection with the example sport tracking system 800 of FIG. 8. In the illustrated example, the first and second goal line coils 2124, 2126 are disposed below (e.g., buried in) in the playing surface 2106 (e.g., beneath the grass/turf). The first and second goal line coils 2124, 2126 are oriented along a plane (e.g., the horizontal plane) that is perpendicular to the plane(s) of interest (i.e., a vertical plane extending upward from the first goal line 2118 and/or the second goal line 2122). In the illustrated example, the first goal line coil 2124 and the second goal line coil 2126 each include one or more sides or portions (e.g., sections) that define a loop. In particular, the first coil includes a first section 2128 aligned along the first goal line 2118, a second section 2130 disposed opposite and parallel to the first section 2128, and a third section 2132 and a fourth section 2134 disposed along the first and second side lines 2112, 2114, respectively, and between the first and second sections 2128, 2130 of the first goal line coil 2124. Likewise, the second goal line coil 2126 includes a first section 2136 aligned along the first goal line 2118, a second section 2138 disposed opposite and parallel to the first section 2136, and a third section 2140 and a fourth section 2142 disposed along the first and second side lines 2112, 2114, respectively, and between the first and second sections 2136, 2138 of the second goal line coil 2126.

In the illustrated example of FIG. 21, the sport tracking system 2100 includes the current generator 626 (FIGS. 6 and 8) that generates AC current in the first and second goal line coils 2124, 2126. The first section 2128 of the first goal line coil 2124 is disposed along the first goal line 2118 and, thus, generates a zero-crossing plane along the first goal line 2118. Similarly, the first section 2136 of the second goal line coil 2126 is disposed along the second goal line 2122 and, thus, generates a zero-crossing plane along the second goal line 2122. In the illustrated example, the first and second goal line coils 2124, 2126 are overlapped, which decreases the warpage of the zero-crossing planes along the first and second goal lines 2118, 2122, as explained in connection with the two coil arrangement in FIG. 8.

In the illustrated example, the football 2104 includes a sensor 2146 that measures and/or detects the Z direction magnetic field $B_Z$. The sensor 2146 may be implemented by any of the example receiver coils 1500, 1600, 1700 of FIG. 15, 16 or 17. When the football 2104 crosses a zero-crossing plane along the first or second goal lines 2118, 2122, the sensor 2146 detects or measures that the strength of the Z magnetic field $B_Z$ is zero, which indicates the football 2104 has crossed the first or second goal lines 2118, 2122. For example, if there is a pile-up of players near the first goal line 2118, it may be difficult (if not impossible) to see whether the football 2104 actually crossed the first goal line 2118. Using the example sport tracking system 2100, a referee or other official can review the Z direction magnetic field $B_Z$ measurements experienced by the sensor 2146 and accurately determine if the football 2104 crossed the first goal line 2118. The calculation of the Z direction magnetic field $B_Z$ measurements can be performed in the football 2104 (e.g., via a processor) or by a zero-crossing analyzer 2147. In some examples, the football 2104 includes a transmitter that transmits the magnetic field measurements to the zero-crossing analyzer 2147. Additionally or alternatively, the football 2104 may include an analyzer or processor to determine whether the football 2104 has crossed the first or second goal lines 2118, 2122. In some examples, the football 2104 includes a memory and a clock. The processor may store a record in the memory indicating a time at which the sensor 2146 detected a zero or substantially zero $B_Z$.

In some examples, the sport tracking system 2100 may include one or more calibration coils to help determine an orientation of the football 2104 at or near the first or second goal lines 2118, 2122. For example, the sport tracking system 2100 of the illustrated example includes a first calibration coil 2148 disposed around the first goal line 2118. In the illustrated example, the current generator 626 (which is electrically coupled to the first calibration coil 2148 via a switch 2149) creates a current in the first calibration coil 2148 to generate a magnetic field in the Z direction through the first calibration coil 2148. Similarly to the calibration coils 2002, 2008 disclosed in connection with FIG. 20, the magnetic field generated by the first calibration coil 2148 may be used to determine an orientation of the football 2104. Then, the orientation may be used to calculate the strength of Z direction magnetic field $B_Z$ experienced by the sensor 2146, so that the sensor 2146 can determine when the football 2104 crosses the zero-crossing plane along the first goal line 2118 (e.g., crosses the vertical plane of interest). Similarly, in the illustrated example of FIG. 21, the sport tracking system 2100 includes a second calibration coil 2150 around the second goal line 2122.

Figure 22:
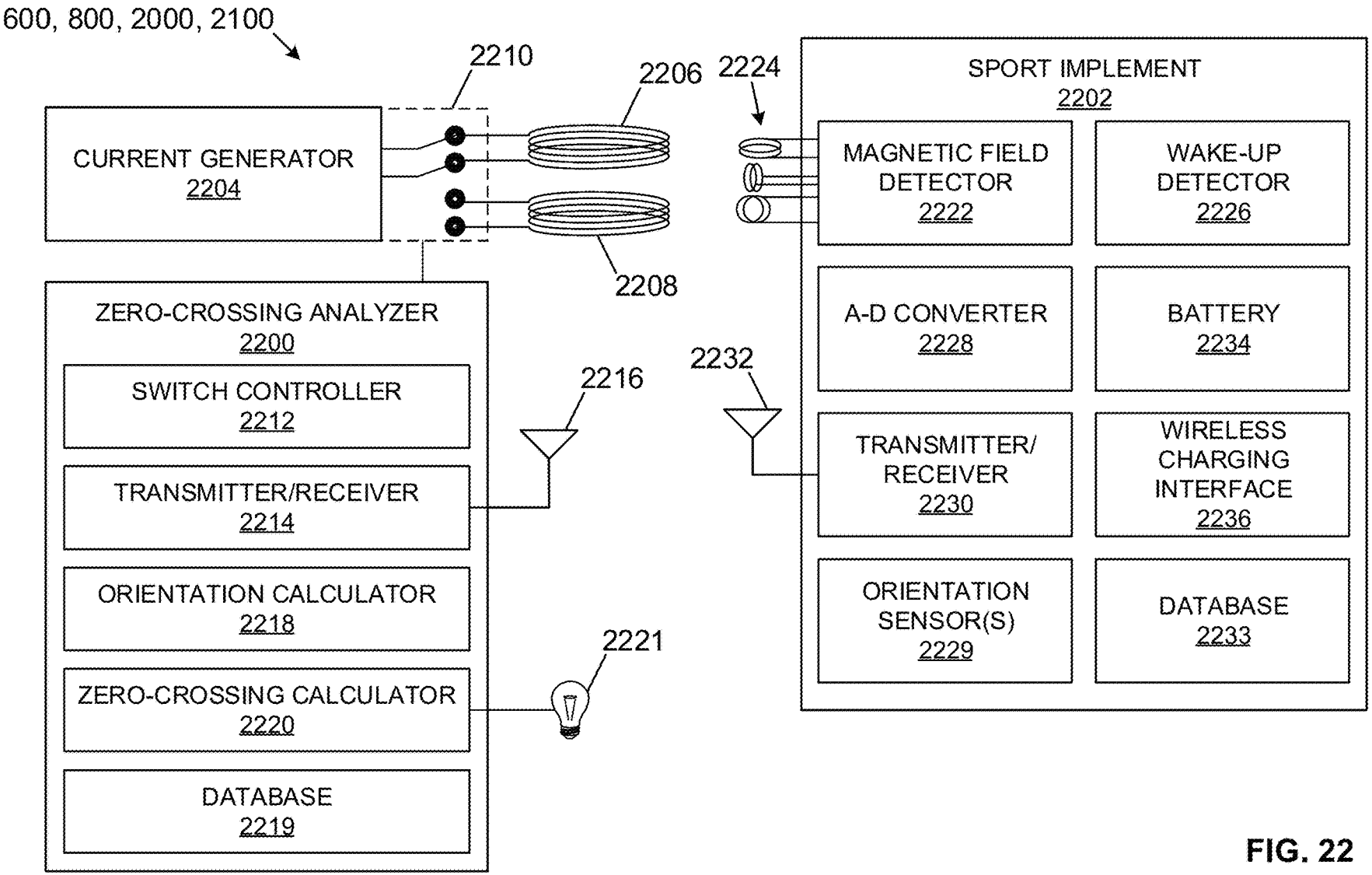
FIG. 22 is a block diagram of an example sport tracking system that may implement any of the example sport tracking systems of FIGS. 6, 8, 20 and 21.

FIG. 22 is a block diagram of an example implementation of any of the example sport tracking systems 600, 800, 2000, 2100 disclosed in connection with FIGS. 6, 8, 20 and 21. In the illustrated example, the example sport tracking systems 600, 800, 2000, 2100 include a zero-crossing analyzer 2200 and a sport implement 2202. The zero-crossing analyzer 2200 may correspond to, for example, any of the example zero-crossing analyzers 638, 828, 2006, 2147 of FIGS. 6, 8, 20 and 21. The sport implement 2202 may correspond to, for example, the example puck 604 of FIGS. 6, 8 and 20, the football 2104 of FIG. 21 and/or any other object of interest to be tracked by the sport tracking systems 600, 800, 2000, 2100.

In the illustrated example, a current generator 2204 supplies current to one or more goal line coils 2206 to generate a magnetic field. The current generator 2204 may correspond to, for example, the current generator 626 of FIGS. 6, 8, 20 and 21. The goal line coil(s) 2206 may correspond to, for example, any of the example goal line coils 624, 806, 808, 1300, 1400, 2124, 2126 of FIGS. 6, 8, 13A, 14, 20 and 21. The goal line coil(s) 2206 may be arranged such that at least a portion of the goal line coil(s) 2206 is aligned along a plane of interest such that a zero-crossing plane is generated through the plane of interest. For example, in the sport tracking system 600 of FIG. 6, the first section 628 of the goal line coil 624 is aligned along (e.g., an under) the first goal line 620. While in the illustrated examples of FIGS. 6, 8, 20 and 21 the coils generate a zero-crossing plane along a vertical plane of interest, in other examples the coils can be orientated in other directions to align along a plane of interest in different direction (e.g., a horizontal plane of interest).

The current generator 2204 may be implemented by a battery or battery pack, a generator, and/or power from a public and/or private power grid. The current generator 2204 provides current to the goal line coil(s) 2206. In some examples, the current generator 2204 supplies LF AC to the goal line coil(s) 2206. In some examples, the current generator 2204 supplies direct current (DC) and a DC-AC converter is provided to generate AC current for the goal line coil(s) 2206.

In some examples, the sport tracking systems 600, 800, 2000, 2100 include one or more calibration coil(s) 2208 that may be used to determine an orientation of the sport implement 2202. The calibration coil(s) 2208 may correspond to, for example, any of the example calibration coils 2002, 2008, 2148, 2150 of FIGS. 20 and 21. In some examples, the calibration coil(s) 2208 are disposed around or near the plane of interest. The calibration coil(s) 2208 generate a magnetic field (e.g., a reference magnetic field) that may be detected by the sport implement 2202 and used to determine an orientation of the sport implement 2202 (e.g., when the sport implement 2202 is near the plane of interest). In the illustrated example of FIG. 22, the current generator 2204 also supplies AC current to the calibration coil(s) 2208. In some examples, a switch 2210 is provided to switch current between the goal line coil(s) 2206 and the calibration coil(s) 2208. The switch 2210 may correspond to, for example, the switch 2004 of FIG. 20 and/or the switch 2149 of FIG. 21. In some examples, the state of the switch 2210 is controlled by the zero-crossing analyzer 2200. For example, in the illustrated example of FIG. 22, the zero-crossing analyzer 2200 includes a switch controller 2212 that controls the state of the switch 2210.

The switch controller 2212 may control the switch 2210 to switch between three states: providing current to the goal line coil(s) 2206, providing current to the calibration coil(s) 2208 and/or turn off power to both coils.

In the illustrated example, the zero-crossing analyzer 2200 includes a transmitter/receiver 2214 (e.g., a transceiver) in communication with an antenna 2216. The transmitter/receiver 2214 may be used to communicate (e.g., wirelessly) with the sport implement 2202, for example. The transmitter/receiver 2214 may be implemented by any radio system, such as Bluetooth® low energy radio. In other examples, other types of communication systems and/or devices using any other past, present or future protocol(s) may be utilized. In some examples, magnetic field information detected by the sport implement 2202 is transmitted from the sport implement 2202 to the zero-crossing analyzer 2200. In the illustrated example of FIG. 22, the zero-crossing analyzer 2200 includes an orientation calculator 2218, which calculates the magnetic field components from the magnetic field information and calculates an orientation of the sport implement 2202. In other words, the orientation calculator calculates the orientation [Φ, θ, Ψ] of the sport implement 2202 based on the magnitude of the magnetic field (e.g., based on the voltage information) received from the sport implement 2202 and stores the orientation information in a database 2219. In the illustrated example, the zero-crossing analyzer 2200 includes a zero-crossing calculator 2220 to calculate the Z direction magnetic field component $B_Z$ and determine whether the sport implement 2202 has crossed a zero-crossing plane (e.g., whether a goal has been scored). The measurements of the calculated Z direction magnetic field component $B_Z$ may be stored in the database 2219. In some examples, the zero-crossing analyzer 2200 outputs a line crossing signal 2221, that may activate a light, a display, an alarm, etc. The line crossing signal 2221 may be used to indicate when the sport implement 2202 has crossed the plane of interest (e.g., a goal line), for example.

In the illustrated example of FIG. 22, the sport implement 2202 includes a magnetic field detector 2222, which detects a magnetic field sensed by one or more receiver coil(s) 2224. The receiver coil(s) 2224 may be implemented by, for example, the receiver coils 1500, 1600, 1700 of FIGS. 15-17 (which include three orthogonal coils to capture magnetic fields along the three major axes). When the receiver coil(s) 2224 are disposed in a magnetic field, a voltage is induced in the coil(s). The magnetic field detector 2222 detects and/or measures the voltage induced in the receiver coil(s) 2224, which is indicative of the strength of the magnetic field experienced by the receiver coil(s) 2224 and, thus, the sport implement 2202.

In the illustrated example, the sport implement 2202 includes a wake-up detector 2226. The wake-up detector 2226 may activate or turn on the other component(s) of the sport implement 2202 when a magnetic field of a sufficient magnitude (e.g., greater than a threshold) is detected. For example, to save or conserve energy, the sport implement 2202 may operate in a dormant, sleep or idle mode until the sport implement 2202 is near the goal line. For instance, the calibration coil 2208 may emit a magnetic field near the goal line. When the sport implement 2202 is disposed in the magnetic field, a voltage is induced in the receiver coil(s) 2224. When the magnetic field detector 2222 detects a sufficient voltage induced in the receiver coil(s) 2224, the wake-up detector 2226 activates or turns on the other component(s) of the sport implement 2202 (e.g., the transmitter/receiver 2230, the A-D converter 2228, etc.), such that the sport implement 2202 can monitor for the zero-crossing plane, for example. In other examples, the sport implement 2202 does not include a wake-up detector.

In the illustrated example, the sport implement 2202 includes a transmitter/receiver 2230 (e.g., a transceiver) in communication with an antenna 2232. The transmitter/receiver 2230 may be used to communicate (e.g., wirelessly) with the transmitter/receiver 2214 of the zero-crossing analyzer 2200. The transmitter/receiver 2230 may be implemented by any type of radio system, such as Bluetooth® low energy radio. In other examples, other types of communication systems and/or devices may be employed. In some examples, the measured voltage(s) and/or the orientation information is transmitted to the zero-crossing analyzer 2200. In illustrated example of FIG. 22, the sport implement 2202 includes an analogue-to-digital (A-D) converter 2228 (e.g., a digitizer). In some examples, the magnetic field detector 2222 performs one or more tuning and/or analog front-end processes (e.g., amplification, filtering, etc.) to the voltage signal(s) before sending the voltage information to the A-D converter 2228, which digitizes the voltage information before transmitting the information to the zero-crossing analyzer 2200. In some examples, the sport implement 2202 includes one or more orientation sensor(s) 2229, such as a gyrometer, to measure the orientation of the receiver coil 2224. The orientation information from the orientation sensor(s) 2229 may be transmitted to the zero-crossing analyzer 2200.

In some examples, the orientation calculator 2218 and/or the zero-crossing calculator 2220 may be implemented in the example sport implement 2202. In other words, the sport implement 2202 may calculate the orientation of the sport implement 2202 and/or Z direction magnetic field component $B_Z$ and transmit the results to the zero-crossing analyzer 2200. The measurements and/or results may be stored in a database 2233. In some examples, the sport implement 2202 stores time-stamped records (e.g., field strength measurements) in the database 2233.

In some examples, to power the component(s) of the sport implement 2202, the sport implement includes a battery 2234. In some examples, the sport implement 2202 includes a wireless charging interface 2236, which enables wireless charging of the battery 2234. As such, the sport implement 2202 does not need a connector or plug on the outside of the sport implement for a connecting wire, which may otherwise interfere with the normal play of the sport implement 2202.

While example manners of implementing the zero-crossing analyzer 2200 and the sport implement 2202 of the sport tracking systems 600, 800, 2000, 2100 of FIGS. 6, 8, 20 and 21 are illustrated in FIG. 22, one or more of the elements, processes and/or devices illustrated in FIG. 22 may be combined, divided, re-arranged, omitted, eliminated and/or implemented in any other way. Further, the example the example switch controller 2212, the example orientation calculator 2218, the example database 2219, the example zero-crossing calculator 2220 and/or, more generally, the example zero-crossing analyzer 2200, the example magnetic field detector 2222, the example wake-up detector 2226, the example A-D converter 2228, the example database 2233 and/or, more generally, the example sport implement 2202 may be implemented by hardware, software, firmware and/or any combination of hardware, software and/or firmware. Thus, for example, any of the example the example switch controller 2212, the example orientation calculator 2218, the example database 2219, the example zero-crossing calculator 2220 and/or, more generally, the example zero-crossing analyzer 2200, the example magnetic field detector 2222, the example wake-up detector 2226, the example A-D converter 2228, the example database 2233 and/or, more generally, the example sport implement 2202 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example the example switch controller 2212, the example orientation calculator 2218, the example database 2219, the example zero-crossing calculator 2220 and/or, more generally, the example zero-crossing analyzer 2200, the example magnetic field detector 2222, the example wake-up detector 2226, the example A-D converter 2228, the example database 2233 and/or, more generally, the example sport implement 2202 is/are hereby expressly defined to include a tangible computer readable storage device or storage disk such as a memory, a digital versatile disk (DVD), a compact disk (CD), a Blu-ray disk, etc. storing the software and/or firmware. Further still, the example zero-crossing analyzer 2200 and/or the example sport implement 2202 of the sport tracking systems 600, 800, 2000, 2100 of FIG. 22 may include one or more elements, processes and/or devices in addition to, or instead of, those illustrated in FIG. 22, and/or may include more than one of any or all of the illustrated elements, processes and devices.

Figure 23:
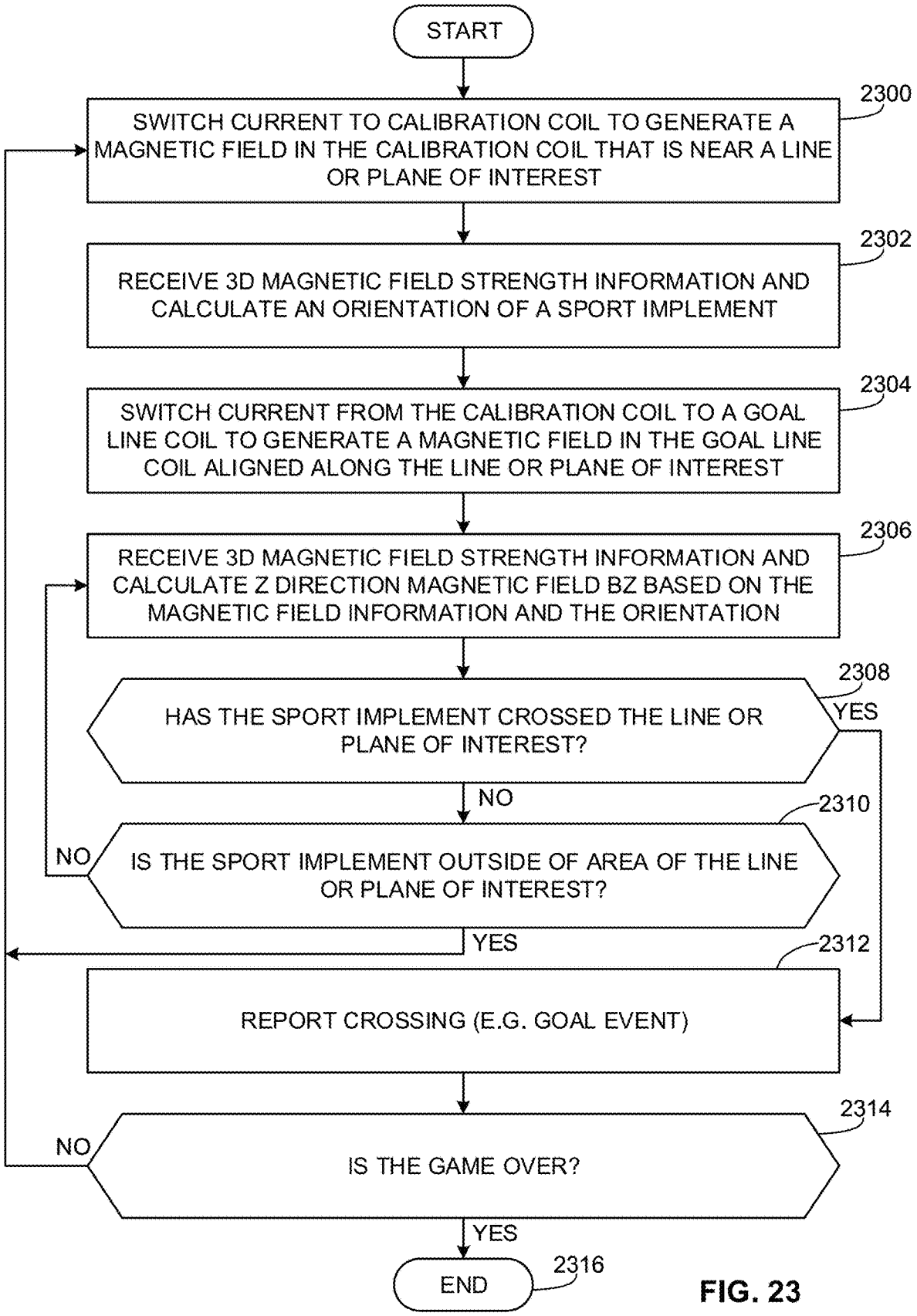
FIG. 23 is a flowchart representative of example machine readable instructions that may be executed to implement an example zero-crossing analyzer of the example sport tracking system of FIG. 22.
Figure 24:
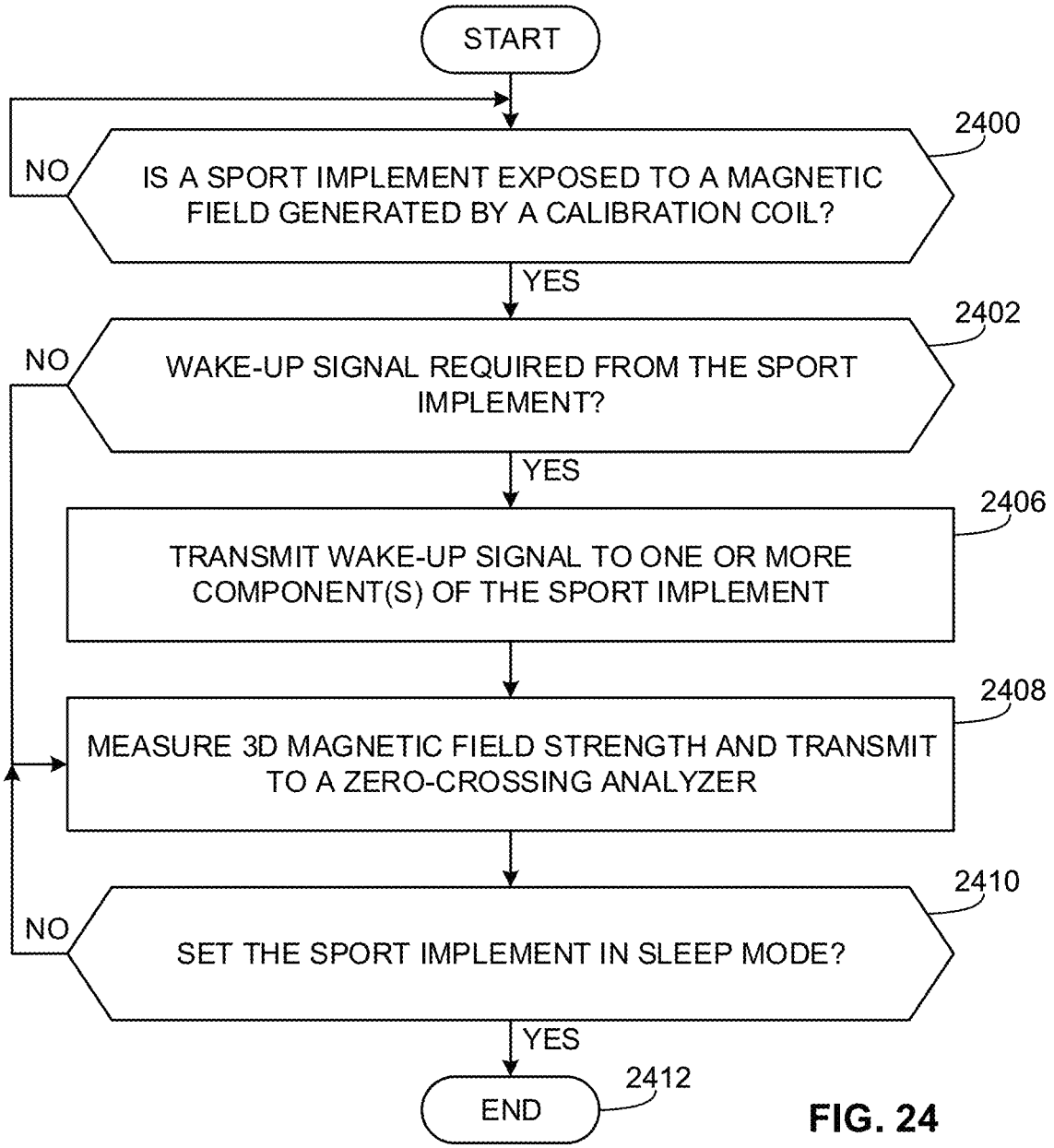
FIG. 24 is a flowchart representative of example machine readable instructions that may be executed to implement an example sport implement of the example sport tracking system of FIG. 22.

Flowcharts representative of example machine readable instructions for implementing the example zero-crossing analyzer 2200 and the example sport implement 2202 of FIG. 22 are shown, respectively, in FIGS. 23 and 24. In these examples, the machine readable instructions implement a program for execution by a processor such as the processor 2512 shown in the example processor platform 2500 discussed below in connection with FIG. 25 and/or the processor 2612 shown in the example processor platform 2600 discussed below in connection with FIG. 26. The program may be embodied in software stored on a tangible computer readable storage medium such as a CD-ROM, a floppy disk, a hard drive, a digital versatile disk (DVD), a Blu-ray disk, or a memory associated with the processor 2512 and/or the processor 2612, but the entire program and/or parts thereof could alternatively be executed by a device other than the processor 2512 or the processor 2612 and/or embodied in firmware or dedicated hardware. Further, although the example programs are described with reference to the flowcharts illustrated in FIGS. 23 and 24, many other methods of implementing the example zero-crossing analyzer 2200 and/or the example sport implement 2202 may alternatively be used. For example, the order of execution of the blocks may be changed, and/or some of the blocks described may be changed, eliminated, or combined.

As mentioned above, the example processes of FIGS. 23 and 24 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals and to exclude transmission media. As used herein, "tangible computer readable storage medium" and "tangible machine readable storage medium" are used interchangeably. Additionally or alternatively, the example processes of FIGS. 23 and 24 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media. As used herein, when the phrase "at least" is used as the transition term in a preamble of a claim, it is open-ended in the same manner as the term "comprising" is open ended.

FIG. 23 is a flowchart representative of example machine readable instructions, which may be executed by the zero-crossing analyzer 2200 of FIG. 22 to implement any of the example sport tracking systems 600, 800, 2000, 2100 of FIGS. 6, 8, 20, 21. The example instructions may be executed to determine whether a sport implement (e.g., a puck, a ball, etc.) and/or another object of interest has crossed a line or plane of interest (e.g., a goal line).

In the example of FIG. 23, at block 2300, the current generator 2204 generates a magnetic field (e.g., a LF AC magnetic field) in the calibration coil 2208. For example, the switch controller 2212 may control the switch 2210 to supply AC to the calibration coil 2208. The calibration coil 2208 may be disposed at or near a line or plane of interest, such as a goal line. For example, in FIG. 20, the first calibration coil 2002 is disposed around the first goal 616 and encompasses a least a portion of the first goal line 620.

At block 2302, the zero-crossing analyzer 2200 receives the 3D magnetic field strength information (e.g., the voltages [V1, V2, V3] induced in the receiver coil(s) 2224) from the sport implement 2202, and the orientation calculator 2218 calculates the orientation [Φ, θ, Ψ] of the sport implement 2202 based on the 3D magnetic field strength information. The zero-crossing analyzer 2200 may communicate with the sport implement 2202 via the transmitter/receiver 2214, for example. In some examples, in addition to or as an alternative to calculating the orientation of the sport implement 2202 based on the magnetic field strength information, the sport implement 2202 may include one or more gyrometers (e.g., the orientation sensor(s) 2229) that measure the angular orientation of the sport implement 2202. The orientation calculator 2218 may receive the orientation information from the sport implement 2202 and determine the orientation of the sport implement 2202.

At block 2304, the current generator 2204 generates a magnetic field (e.g., a LF AC magnetic field) in the goal line coil 2206. In some examples, once the orientation of the sport implement 202 is determined (e.g., via blocks 2300-2302), the switch controller 2212 switches power (via the switch 2210) from the calibration coil 2208 to the goal line coil 2206. Thus, in some examples, only one of the goal line coil 2206 or the calibration coil 2208 is energized or active at a time. At least a portion of the goal line coil 2206 is aligned along a line or plane of interest to create a zero-crossing plane along the line or plane of interest. For example, in the sport tracking system 600 of FIG. 6, the first section 628 of the goal line coil 624 is disposed along the first goal line 620 such the Z direction magnetic field component is in the vertical direction. Thus, the zero-crossing plane 700 (FIG. 7) is generated along the first goal line 620 (e.g., a line of interest). In some examples, a sport tracking system may include multiple goal line coil(s) 2206, and the current generator 2204 generates magnetic fields in multiple ones of the goal line coil(s) 2206. For example, the sport tracking system 800 of FIG. 8 includes the first and second goal line coils 806, 808. In some examples, utilizing two overlapping goal line coils helps reduce the warpage of the zero-crossing plane, as illustrated in FIG. 9.

At block 2306 of FIG. 23, the zero-crossing analyzer 2200 receives the 3D field strength information (e.g., the voltages [V1', V2', V3'] induced in the receiver coil(s) 2224) experienced by the sport implement 2202, and the zero-crossing calculator 2220 calculates the Z direction magnetic field $B_Z$ based on the measured field strength [V1', V2', V3'] and the orientation [Φ, θ, Ψ]. In other words, the sport implement 2202 transmits the voltage measurements detected by the receiver coil(s) 2224 to the zero-crossing analyzer 2200, and the zero-crossing calculator 2220 calculates the Z direction magnetic field $B_Z$ using the voltage measurements information and the previously determined orientation information (e.g., stored in the database 2219). The Z direction magnetic field $B_Z$ may be calculated using Equation 8 above.

At block 2308, the zero-crossing calculator 2220 determines whether the sport implement 2202 has crossed the line or plane of interest based on the magnitude of the magnitude field. In some examples, the zero-crossing calculator determines the sport implement 2202 has crossed the line or plane of interest when the Z direction magnetic field $B_Z$ (as calculated at block 2306) is zero or within a tolerance margin of zero (e.g., a noise tolerance of zero). Additionally or alternatively, the zero-crossing calculator 2220 may determine a crossing based on an inflection in the magnitude of the Z direction magnetic field $B_Z$. For example, the zero-crossing calculator 2220 may calculate a series of measurements (e.g., and stored in the database 2219) of the magnitude of the Z direction magnetic field $B_Z$, and if the magnitude changes from positive to negative, or vice versa, the zero-crossing calculator 2220 determines the sport implement 2202 has crossed the zero-crossing plane of the goal line coil 2206 and, thus, has crossed the line or plane of interest. If the magnitude of the Z direction magnetic field $B_Z$ is not zero or substantially zero, and/or has not exhibited an inflection, the zero-crossing calculator 2220 determines the sport implement 2202 has not crossed the zero-crossing plane and, thus, has not crossed the line or plane of interest.

At block 2310, the zero-crossing analyzer 2200 determines whether the sport implement 2202 is outside of an area of or away from the line or plane of interest, such as the goal line. If the sport implement 2202 is still close to the goal line, for instance, the zero-crossing calculator 2220 continues to calculate the Z direction magnetic field $B_Z$ (block 2306) and determine whether the sport implement 2202 has crossed the line or plane of interest (block 2308). In other words, the sport implement 2202 is still located near the goal line or plane of interest and, thus, the zero-crossing calculator 2220 continues monitoring for a crossing. Otherwise, if the sport implement 2202 is outside of the area of the goal line, power can be switched from the goal line coil 2206 back to the calibration coil 2208 (block 2300). For example, the sport implement 2202 may have been moved away from the goal line or plane of interest and the orientation may be calculated again when the sport implement 2202 subsequently approaches the goal line. This reset of the calibration coil 2208 can be based on one or more events, such as a player hitting the sport implement 2202 away from the goal (e.g., toward the other goal on the other side of the hockey rink), a referee or other official calling a time out and moving the sport implement 2202 toward the center of the hockey rink, based on an increase of measured field strength above a threshold (e.g., because the sport implement 2202 moves back toward the center of the goal line coil 2206 where the magnetic field is stronger), etc.

If the zero-crossing calculator 2220 determines whether the sport implement 2202 has crossed the line or plane of interest (as determined at block 2308), the zero-crossing calculator 2220 reports a crossing (block 2312), which may correspond to a goal, for example. In some examples, the zero-crossing calculator 2220 outputs the line crossing signal 2221 (e.g., to activate a light, an alarm, an icon or indicator on a display screen, etc.).

At block 2314, the zero-crossing analyzer 2200 determines if the game is over. In some examples, the zero-crossing analyzer 2200 determines if the game is over based on a timer and/or input from a referee or other official. If the game is not over, control returns to block 2300 where the switch controller 2212 controls the switch 2210 to supply power from the current generator 2204 to the calibration coil 2208 to generate a magnetic field in the calibration coil 2208 (block 2300). In some examples, multiple calibration coils and/or goal line coils may be implemented. In some such examples, two or more threads may execute two or more instances of some or all of the instructions of FIG. 23 in parallel. Otherwise, if the game is over (determined at block 2314), execution of the instructions ends (block 2316).

In some examples, in addition to or as an alternative to determining whether the sport implement 2202 has crossed the zero-crossing plane, the zero-crossing calculator 2220 may determine a location of the sport implement 2202 relative to the zero-crossing plane (e.g., the plane of interest). For example, referring to FIGS. 12B and 12B, the strength or magnitude of the magnetic field at different distances from the zero-crossing plane can be predetermined. Depending on the magnitude of magnetic field experienced by the sport implement 2202, the zero-crossing calculator 2220 may determine the location of the sport implement 2202 from the zero-crossing plane.

FIG. 24 is a flowchart representative of example machine readable instructions, which may be executed by the sport implement 2202 of FIG. 22 to implement the example puck 604 of FIGS. 6, 8, 20 and/or the example football 2104 of FIG. 21. At block 2400, the magnetic field detector 2222 monitors the receiver coil(s) 2224 to determine whether the sport implement 2202 is exposed to the magnetic field generated by the calibration coil 2208. In particular, the sport implement 2202 includes the receiver coil(s) 2224. When the receiver coil(s) 2224 are exposed to the magnetic field generated by the calibration coil 2208, voltage signals are induced in the receiver coil(s) 2224, which are detected by the magnetic field detector 2222. The magnetic field detector 2222 monitors for voltages induced in the receiver coil(s) 2224. If no voltages are sensed, the magnetic field detector 2222 continues to monitor for voltages (block 2400). If the magnetic field detector 2222 measures voltages, the magnetic field detector 2222 determines the sport implement 2202 is exposed to the magnetic field generated by the calibration coil 2208.

At block 2402, the wake-up detector 2226 determines whether a wake-up signal is required to turn on or activate the other component(s) of the sport implement 2202. For example, to save or conserve energy, the sport implement 2202 may operate in a dormant, sleep or idle mode until the sport implement 2202 is near the goal line (e.g., as determined when the sport implement 2202 is in the magnetic field of the calibration coil 2208 at block 2300). In some examples, the other component(s) of the sport implement 2202 may already be active. If a wake-up signal is required, the wake-up detector 2226 transmits a wake-up signal to activate or turn on the other component(s) at block 2406.

At block 2408, the magnetic field detector 2222 detects and/or measures the 3D magnetic field strength [V1, V2, V3] induced in the receiver coil(s) 2224. The field strength measurements may be digitized via the A-D converter 2228. In some examples, the sport implement 2202 transmits the field strength measurements (via the transmitter/receiver 2230) to the zero-crossing analyzer 2200 so that the orientation calculator 2218 may calculate the orientation [Φ, θ, Ψ] of the of the sport implement 2202 based on the magnetic field strength information. Additionally or alternatively, the sport implement 2202 may include the orientation sensor(s) 2229 that determine an orientation of the sport implement 2202 and/or the receiver coil(s) 2224, and the sport implement 2202 may transmit the orientation information to the zero-crossing analyzer 2200. In other examples, the orientation calculation performed by the orientation calculator 2218 (e.g., at block 2302 of FIG. 23) is executed in the sport implement 2202 (e.g., by the magnetic field detector 2222).

In some examples, after the orientation of the sport implement 2202 is calculated, the goal line coil 2206 is energized, which generates a magnetic field. The magnetic field detector 2222 continues to measure the 3D magnetic field strength [V1', V2', V3'] experienced by the sport implement 2202. In some examples, the sport implement 2202 transmits the field strength measurements (via the transmitter/receiver 2230) to the zero-crossing analyzer 2200 so that the zero-crossing calculator 2220 calculates the Z direction magnetic field $B_Z$ based on the measured field strength [V1', V2', V3'] and the orientation [Φ, θ, Ψ]. In other words, the sport implement 2202 transmits the voltage measurements detected by the receiver coil 2224 to the zero-crossing analyzer 2200, and the zero-crossing calculator 2220 of the zero-crossing analyzer 2200 calculates the Z direction magnetic field $B_Z$ using the voltage measurements information and the previously determined orientation information. In other examples, the calculation of the Z direction magnetic field $B_Z$ performed by the zero-crossing calculator 2220, the determination of whether the sport implement 2202 has crossed the plane of interest, and/or the determination of whether the sport implement is outside of the area of the line or plane of interest (blocks 2306-2310 of FIG. 23) may be executed in the sport implement 2202. In some such examples, the sport implement 2202 reports when a crossing of the line or plane of interest has been detected. In some such examples, the sport implement 2202 may communicate with the zero-crossing analyzer 2200 to switch power between the calibration coil(s) 2208 and the goal line coil(s) 2206.

At block 2410, the wake-up detector 2226 determines whether to set the sport implement 2202 to sleep mode. As mentioned above, if the sport implement 2202 is not near the goal line, then the component(s) of the sport implement may be turned off or operated in a sleep or dormant mode to conserve energy. In some examples, the wake-up detector 2226 determines to implement the sleep mode based on the strength of the magnetic field (e.g., being above a threshold value) detected by the magnetic field detector 2222. For example, if the sport implement 2202 travels away from the zero-crossing plane and toward a center of the goal line coil 2206, the magnetic field increases. If the magnetic field increases beyond a threshold amount, the wake-up detector 2226 may determine to implement the sleep mode. In other examples, this determination may be based on other events, such as the occurrence of a goal. If the wake-up detector 2226 determines the sport implement 2202 should still be active, the sport implement continues to measure the 3D magnetic field at block 2408. Otherwise, if the sport implement 2202 is to be switch to sleep mode (e.g., because a goal has been scored, and/or the game is over (determined at block 2410)), execution of the instructions ends (block 2412).

Figure 25:
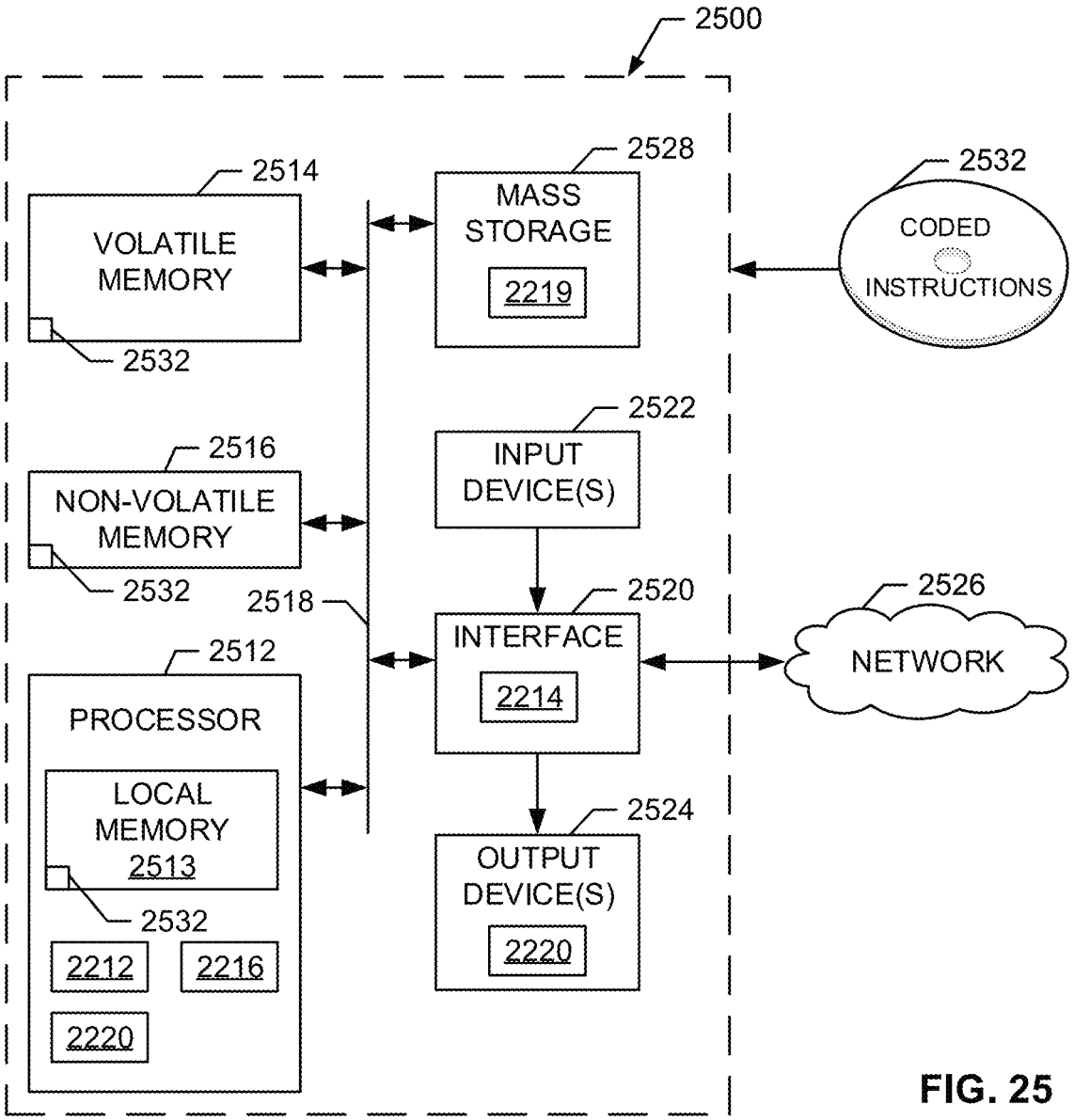
FIG. 25 is a processor platform that may execute the example instructions of FIG. 23 to implement the zero-crossing analyzer of FIG. 22.

FIG. 25 is a block diagram of an example processor platform 2500 capable of executing the instructions of FIG. 23 to implement the zero-crossing analyzer 2200 of FIG. 22. The processor platform 2500 can be, for example, a server, a personal computer or any other type of computing device.

The processor platform 2500 of the illustrated example includes a processor 2512. The processor 2512 of the illustrated example is hardware. For example, the processor 2512 can be implemented by one or more integrated circuits, logic circuits, microprocessors or controllers from any desired family or manufacturer. The processor 2512 may implement the example switch controller 2212, the example orientation calculator 2218 and/or the example zero-crossing calculator 2220, for example.

The processor 2512 of the illustrated example includes a local memory 2513 (e.g., a cache). The processor 2512 of the illustrated example is in communication with a main memory including a volatile memory 2514 and a non-volatile memory 2516 via a bus 2518. The volatile memory 2514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 2516 may be implemented by flash memory and/or any other desired type of memory device. Access to the main memory 2514, 2516 is controlled by a memory controller.

The processor platform 2500 of the illustrated example also includes an interface circuit 2520. The interface circuit 2520 may be implemented by any type of interface standard, such as an Ethernet interface, a universal serial bus (USB), and/or a PCI express interface. The example interface circuit 2520 may implement the example transmitter/receiver 2214, for example.

In the illustrated example, one or more input devices 2522 are connected to the interface circuit 2520. The input device (s) 2522 permit(s) a user to enter data and commands into the processor 2512. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 2524 are also connected to the interface circuit 2520 of the illustrated example. The output devices 2524 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). The interface circuit 2520 of the illustrated example, thus, typically includes a graphics driver card, a graphics driver chip or a graphics driver processor. The example output device(s) 2524 may implement the example switch 2210 and/or example line crossing signal 2221, for example.

The interface circuit 2520 of the illustrated example also includes a communication device such as a transmitter, a receiver, a transceiver, a modem and/or network interface card to facilitate exchange of data with external machines (e.g., computing devices of any kind) via a network 2526 (e.g., an Ethernet connection, a digital subscriber line (DSL), a telephone line, coaxial cable, a cellular telephone system, etc.).

The processor platform 2500 of the illustrated example also includes one or more mass storage devices 2528 for storing software and/or data. Examples of such mass storage devices 2528 include floppy disk drives, hard drive disks, compact disk drives, Blu-ray disk drives, RAID systems, and digital versatile disk (DVD) drives. The mass storage devices 2528 may implement the database 2219, for example.

Coded instructions 2532 of FIG. 23 may be stored in the mass storage device 2528, in the volatile memory 2514, in the non-volatile memory 2516, and/or on a removable tangible computer readable storage medium such as a CD or DVD.

Figure 26:
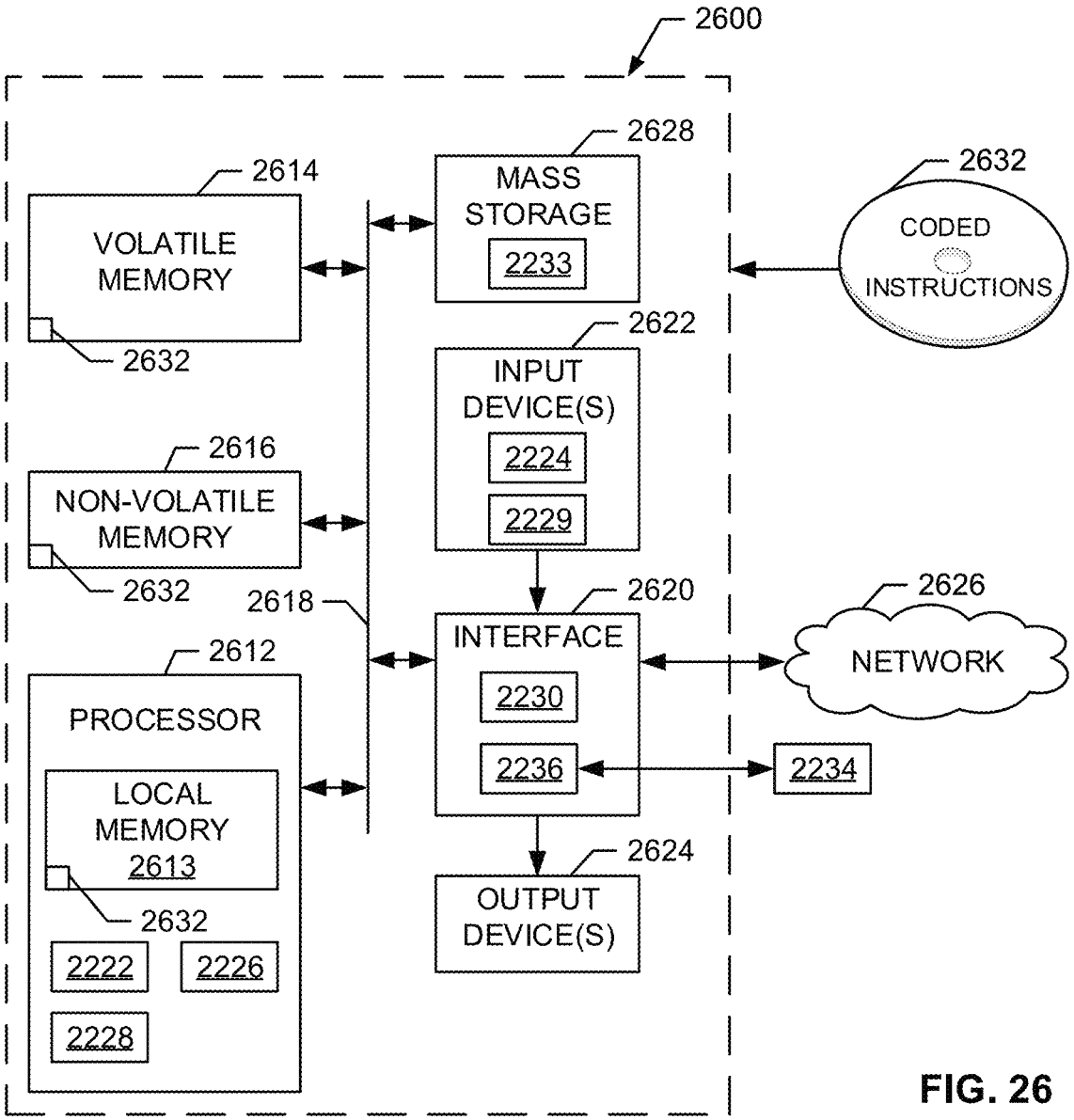
FIG. 26 is a processor platform that may execute the example instructions of FIG. 24 to implement the sport implement of FIG. 22.

FIG. 26 is a block diagram of an example processor platform 2600 capable of executing the instructions of FIG. 24 to implement the sport implement 2202 of FIG. 22. The processor platform 2600 can be, for example, a server, a personal computer or any other type of computing device.

The processor platform 2600 of the illustrated example includes a processor 2612. The processor 2612 of the illustrated example is hardware. For example, the processor 2612 can be implemented by one or more integrated circuits, logic circuits, microprocessors or controllers from any desired family or manufacturer. The processor 2612 may implement the example magnetic field detector 2222, the example wake-up detector 2226 and/or the example A-D converter 2228, for example.

The processor 2612 of the illustrated example includes a local memory 2613 (e.g., a cache). The processor 2612 of the illustrated example is in communication with a main memory including a volatile memory 2614 and a non-volatile memory 2616 via a bus 2618. The volatile memory 2614 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 2616 may be implemented by flash memory and/or any other desired type of memory device. Access to the main memory 2614, 2616 is controlled by a memory controller.

The processor platform 2600 of the illustrated example also includes an interface circuit 2620. The interface circuit 2620 may be implemented by any type of interface standard, such as an Ethernet interface, a universal serial bus (USB), and/or a PCI express interface. The example interface circuit 2620 may implement the example transmitter/receiver 2230 and/or the example wireless charging interface 2236, for example. In the illustrated example, the wireless charging interface 2620 may be used to charge the batter 2234.

In the illustrated example, one or more input devices 2622 are connected to the interface circuit 2620. The input device(s) 2622 permit(s) a user to enter data and commands into the processor 2612. The input device(s) can be implemented by, for example, an audio sensor, a microphone, a camera (still or video), a keyboard, a button, a mouse, a touchscreen, a track-pad, a trackball, isopoint and/or a voice recognition system. The input device(s) 2622 may implement the example receiver coil(s) 2224 and/or the example orientation sensor(s) 2229, for example.

One or more output devices 2624 are also connected to the interface circuit 2620 of the illustrated example. The output devices 2624 can be implemented, for example, by display devices (e.g., a light emitting diode (LED), an organic light emitting diode (OLED), a liquid crystal display, a cathode ray tube display (CRT), a touchscreen, a tactile output device, a printer and/or speakers). In some examples, the output devices 2624 may include the line crossing signal 2221, which may active an alarm, active a light, generate a display, etc. The interface circuit 2620 of the illustrated example, thus, typically includes a graphics driver card, a graphics driver chip or a graphics driver processor.

The interface circuit 2620 of the illustrated example also includes a communication device such as a transmitter, a receiver, a transceiver, a modem and/or network interface card to facilitate exchange of data with external machines (e.g., computing devices of any kind) via a network 2626 (e.g., an Ethernet connection, a digital subscriber line (DSL), a telephone line, coaxial cable, a cellular telephone system, etc.).

The processor platform 2600 of the illustrated example also includes one or more mass storage devices 2628 for storing software and/or data. Examples of such mass storage devices 2628 include floppy disk drives, hard drive disks, compact disk drives, Blu-ray disk drives, RAID systems, and digital versatile disk (DVD) drives. The mass storage devices 2628 may implement the database 2233, for example.

Coded instructions 2632 of FIG. 24 may be stored in the mass storage device 2628, in the volatile memory 2614, in the non-volatile memory 2616, and/or on a removable tangible computer readable storage medium such as a CD or DVD.

Example methods, apparatus, systems and/or articles of manufacture to track a sport implement or object of interest are disclosed herein. Further examples and combinations thereof include the following:

Example 1 includes an apparatus including a first coil to generate a first magnetic field having a first vertical component with a zero magnitude along a first line of interest, a second coil partially overlapped with the first coil, the second coil to generate a second magnetic field, a sensor to measure a magnitude of the first magnetic field in the first line of interest, and a processor to determine an object of interest has crossed the first line of interest based on the magnitude of the first magnetic field measured by the sensor.

Example 2 includes the apparatus of Example 1, wherein the processor is to determine the object of interest has crossed the first line of interest when the magnitude of the first magnetic field measured by the sensor is at least one of zero or within a tolerance margin of zero.

Example 3 includes the apparatus of any of Examples 1 or 2, wherein the second magnetic field has a second vertical component with a zero magnitude along a second line of interest, and the processor is to determine the object of interest has crossed the second line of interest when the magnitude of the second magnetic field measured by the sensor is at least one of zero or within a tolerance margin of zero.

Example 4 includes the apparatus of any of Examples 1-3, wherein the first line of interest is along a first goal line of a sports field, the second line of interest is along a second goal line of the sports field, and the object of interest is a sport implement.

Example 5 includes the apparatus of Example 4, wherein the first coil and the second coil are disposed below a playing surface of the sports field.

Example 6 includes the apparatus of any of Examples 1-4, wherein the first coil includes a first turn and a second turn, the first turn disposed below a playing surface of the sports field, and the second turn routed along a frame of a sports goal.

Example 7 includes the apparatus of any of Examples 1-6, wherein partially overlapping the first and second coils results in less bowing of the first vertical component of the first magnetic field along the first line of interest and less bowing of the second vertical component of the second magnetic field along the second line of interest.

Example 8 includes the apparatus of any of Examples 1-7, wherein first coil forms a first planar ring and the second coil forms a second planar ring, the first and second planar rings being substantially the same size, and centers of the first and second planar rings are not aligned.

Example 9 includes the apparatus of any of Examples 1-8, wherein at least one of the first magnetic field or the second magnetic field is generated from a low frequency alternating current.

Example 10 includes the apparatus of any of Examples 1-9, further including a current generator to generate a current in the first coil and the second coil in a same direction.

Example 11 includes the apparatus of any of Examples 1-10, wherein the sensor includes orthogonal receiver coils.

Example 12 includes the apparatus of Example 11, wherein the sensor includes a Maxwell coil.

Example 13 includes the apparatus of any of Examples 1-12, wherein the sensor is disposed in the object of interest.

Example 14 includes the apparatus of any of Examples 1-13, wherein the object of interest includes a transmitter to transmit the magnitude of the first magnetic field as measured by the sensor to the processor.

Example 15 includes the apparatus of any of Examples 1-14, wherein the processor is to determine whether the object of interest has crossed the first line of interest based on an orientation of the object of interest.

Example 16 includes the apparatus of Example 15, further including a calibration coil to generate a third magnetic field near the first line of interest.

Example 17 includes the apparatus of Example 16, wherein the sensor is to measure a magnitude of the third magnetic field experienced by the object of interest, and the processor is to calculate an orientation of the object of interest based on the magnitude of the third magnetic field measured by the sensor.

Example 18 includes the apparatus of Example 15, further including a gyrometer to measure the orientation of the object of interest.

Example 19 includes an apparatus including a first coil disposed near a line of interest, a second coil having a section aligned with the line of interest, and a processor. The processor is to energize the first coil to generate a first magnetic field, determine an orientation of an object of interest based on the first magnetic field, de-energize the first coil and energize the second coil to generate a second magnetic field, and determine whether the object of interest has crossed the line of interest based on the orientation of the object of interest and a characteristic of the second magnetic field experienced by the object of interest.

Example 20 includes the apparatus of Example 19, further including a sensor to measure the first magnetic field.

Example 21 includes the apparatus of Example 20, wherein the processor is to determine the orientation of the object of interest based on a strength of the first magnetic field measured by the sensor.

Example 22 includes the apparatus of Example 20, wherein the sensor includes orthogonal receiver coils.

Example 23 includes the apparatus of Example 20, wherein the sensor includes a Maxwell coil.

Example 24 includes the apparatus of any of Examples 19-23, further including a switch controlled by the processor to selectively apply current to the first coil or the second coil.

Example 25 includes a sports field monitoring system including a coil disposed below a playing surface, a section of the coil aligned along a goal line of the playing surface, a magnetic field generated by the coil exhibiting a positive magnitude on a first side of the goal line, a negative magnitude on a second side of the goal line, and a point of inflection in magnitude at the goal line, and a calibration coil disposed below the playing surface and circumscribing a goal near the goal line.

Example 26 includes the sports field monitoring system of Example 25, wherein the playing surface is ice, grass or turf.

Example 27 includes a method including generating, with a first coil, a first magnetic field having a first vertical component with a zero magnitude along a first line of interest, generating, with a second coil, a second magnetic field, the second coil partially overlapped with the first coil, and determining whether an object of interest has crossed the first line of interest based on a magnitude of the first magnetic field as measured in the first line of interest.

Example 28 includes the method of Example 27, further including measuring, with a sensor, the magnitude of the first magnetic field.

Example 29 includes the method of Example 28, wherein the sensor is disposed in the object of interest.

Example 30 includes the method of Example 29, further including transmitting, with a transmitter in the object of interest, the magnitude of the first magnetic field measured with the sensor to a processor.

Example 31 includes the method of any of Examples 27-30, wherein the generating of the first magnetic field and the generating of the second magnetic field includes supplying low frequency alternating currents to the first and second coils.

Example 32 includes the method of any of Examples 27-31, further including determining the object of interest has crossed the first line of interest when the magnitude of the first magnetic field is at least one of zero or within a tolerance margin of zero.

Example 33 includes the method of Example 32, wherein the second magnetic field has a second vertical component with a zero magnitude along a second line of interest, and further including determining the object of interest has crossed the second line of interest when the magnitude of the second magnetic field is at least one of zero or within a tolerance margin of zero.

Example 34 includes the method of any of Examples 27-33, wherein determining whether the object of interest has crossed the first line of interest is based on an orientation of the object of interest.

Example 35 includes the method of Example 34, further including determining the orientation of the object of interest via a gyrometer.

Example 36 includes the method of Example 34, further including determining the orientation of the object of interest using a calibration coil.

Example 37 includes the method of any of Examples 27-36, wherein the first line of interest is aligned along a goal line of a sports field, and the object of interest is a sport implement.

Example 38 includes the method of Example 37, wherein the first coil and the second coil are disposed below a playing surface of the sports field.

Example 39 includes a method including energizing a first coil to generate a first magnetic field near a line of interest, determining an orientation of an object of interest based on the first magnetic field, energizing a second coil to generate a second magnetic field, the first coil de-energized when the second coil is energized, and determining whether the object of interest has crossed the line of interest based on the orientation of the object of interest and a characteristic of the second magnetic field as experienced by the object of interest.

Example 40 includes the method of Example 39, further including measuring a strength of the first magnetic field as experienced by the object of interest, and determining the orientation of the object of interest based on the strength of the first magnetic field as experienced by the object of interest.

From the foregoing, it will be appreciated that methods, apparatus, systems and/or articles of manufacture have been described which can be used to accurately determine whether an object of interest has crossed a line or plane of interest such as a goal line. The above disclosed methods, apparatus, systems and/or articles of manufacture can be used for accurate detection of goals or the like. Additionally, examples disclosed herein may be used to determine crossing of a goal line or other plane of interest that is not defined by a goal frame or goal post. As such, examples disclosed herein can be used with more sports and in more applications than known systems. Further, examples disclosed herein do not require modifying a goal frame or goal post. Thus, examples disclosed herein are less complex than known systems.

Examples disclosed herein enable accurate tracking of an object of interest within a few millimeters or less. Thus, examples disclosed herein can be employed with systems to track relatively small movements. Further, while examples disclosed herein are shown in the context of hockey and football, the teachings of this disclosure may be applied to many other sport application or non-sport application(s). For example, teachings of this disclosure may be applied to location/movement tracking of objects such as drones, robots, items, wearables, etc.

Although certain example methods, apparatus, systems and/or articles of manufacture have been disclosed herein, the scope of coverage of this patent is not limited thereto. On the contrary, this patent covers all methods, apparatus, systems and/or articles of manufacture fairly falling within the scope of the claims of this patent.

What is claimed is:

1. An apparatus comprising:

a first coil near a line of interest;

a second coil having a section to be aligned with the line of interest; and a processor to:

cause the first coil to be energized, the first coil to generate a first magnetic field based on current from a current source;

determine an orientation of an object of interest based on the first magnetic field;

in response to the determination of the orientation, cause the current from the current source to switch from the first coil to the second coil to de-energize the first coil and energize the second coil, the second coil to generate a second magnetic field; and determine whether the object of interest has crossed the line of interest based on the orientation of the object of interest and a characteristic of the second magnetic field experienced by the object of interest.

2. The apparatus of claim 1, further including a sensor to measure the first magnetic field.

3. The apparatus of claim 2, wherein the sensor includes orthogonal receiver coils.

4. The apparatus of claim 2, wherein the sensor includes a Maxwell coil.

5. The apparatus of claim 2, wherein the processor is to determine the orientation of the object of interest based on a strength of the first magnetic field measured by the sensor.

6. The apparatus of claim 5, wherein the second magnetic field has a vertical component with a zero magnitude along the line of interest.

7. The apparatus of claim 6, wherein the characteristic of the second magnetic field is a strength of the vertical component of the second magnetic field measured by the sensor.

8. The apparatus of claim 7, wherein the object of interest includes a transmitter to transmit signals representative of the strength of the first magnetic field and the strength of the vertical component of the second magnetic field to the processor.

9. The apparatus of claim 1, further including a switch in circuit with the processor to selectively switch the current from the first coil to the second coil.

10. A method comprising:

directing current from a current source to a first coil, the first coil to generate a first magnetic field near a line of interest based on the current;

determining an orientation of an object of interest based on the first magnetic field;

in response to determining the orientation, directing the current source from the first coil to a second coil to de-energize the first coil and energize the second coil the second coil to generate a second magnetic field; and determining whether the object of interest has crossed the line of interest based on the orientation of the object of interest and a characteristic of the second magnetic field as detected by the object of interest.

11. The method of claim 10, further including measuring a strength of the first magnetic field at the object of interest, wherein the determining of the orientation of the object of interest is based on the measured strength of the first magnetic field.

12. The method of claim 11, wherein the second magnetic field has a vertical component with a zero magnitude along the line of interest.

13. The method of claim 12, wherein the characteristic is a strength of the vertical component of the second magnetic field as detected by the object of interest.

14. The method of claim 12, further including:

measuring, with a sensor in the object of interest, the strength of the first magnetic field and the strength of the vertical component of the second magnetic field; and transmitting, with a transmitter in the object of interest, data indicative of the strength of the first magnetic field and the strength of the vertical component of the second magnetic field to a remote processor.

15. A non-transitory computer readable storage medium comprising instructions which, when executed, cause at least one processor to:

cause a first coil to be energized by directing current from a current source to the first coil, the first coil to generate a first magnetic field near a line of interest;

determine an orientation of an object of interest based on the first magnetic field;

in response to the determination of the orientation, cause the current source to switch from the first coil to a second coil to de-energize the first coil and energize the second coil, the second coil to generate a second magnetic field; and determine whether the object of interest has crossed the line of interest based on the orientation of the object of interest and a characteristic of the second magnetic field as detected by the object of interest.

16. The non-transitory computer readable storage medium of claim 15, wherein the instructions cause the at least one processor to determine a strength of the first magnetic field at the object of interest, and the determining of the orientation of the object of interest is based on the strength of the first magnetic field.

17. The non-transitory computer readable storage medium of claim 15, wherein the second magnetic field has a vertical component with a zero magnitude along the line of interest.

18. The non-transitory computer readable storage medium of claim 17, wherein the characteristic is a strength of the vertical component of the second magnetic field as detected by the object of interest.

19. The non-transitory computer readable storage medium of claim 17, wherein the instructions cause the at least one processor to:

obtain data indicative of a strength of the first magnetic field and a strength of the vertical component of the second magnetic field from the object of interest.

* * * * *